US007590378B2

(12) United States Patent
Fuchs et al.

(10) Patent No.: US 7,590,378 B2
(45) Date of Patent: Sep. 15, 2009

(54) DEVICE AND METHOD FOR GUIDING A CONTINUOUS WEB BY MEANS OF A PIVOTABLE APPARATUS

(75) Inventors: Werner Fuchs, Wörthsee (DE); Hans Taubenberger, Gmund (DE); Günther Gassner, Mühldorf (DE); Friedrich Meschenmoser, Grasbrunn (DE)

(73) Assignee: Oce Printing Systems GmbH, Poing (DE)

( * ) Notice: Subject to any disclaimer, the term of this patent is extended or adjusted under 35 U.S.C. 154(b) by 553 days.

(21) Appl. No.: 10/530,147

(22) PCT Filed: Oct. 10, 2003

(86) PCT No.: PCT/EP03/11268

§ 371 (c)(1),
(2), (4) Date: Oct. 14, 2005

(87) PCT Pub. No.: WO2004/035315

PCT Pub. Date: Apr. 29, 2004

(65) Prior Publication Data

US 2006/0147232 A1 Jul. 6, 2006

(30) Foreign Application Priority Data

Oct. 11, 2002 (DE) ..... 104 47 456

(51) Int. Cl.
*G03G 15/00* (2006.01)

(52) U.S. Cl. ..... 399/384; 399/375; 226/21

(58) Field of Classification Search ..... 399/375, 399/384; 226/21
See application file for complete search history.

(56) References Cited

U.S. PATENT DOCUMENTS 3,600,551 A 8/1971 Flanagan (Continued)

FOREIGN PATENT DOCUMENTS

DE 1 424 318 10/1968

(Continued)

OTHER PUBLICATIONS

Patent Abstracts of Japan—01187160—Jul. 26, 1989.

(Continued)

*Primary Examiner*—Judy Nguyen
*Assistant Examiner*—Andy L Pham
(74) *Attorney, Agent, or Firm*—Schiff Hardin LLP

(57) ABSTRACT

In a method or device for guiding an endless web, the endless web is guided via a first positionable roll to an additional positionable roll with a predetermined angle of wrap on each roll, shafts of the rolls lying parallel to one another in a plane and being held by a frame. The web is fed to and led away from the positionable rolls via a respective first stationary roll and a respective additional stationary roll. The frame is pivoted relative to the stationary rolls about a first axis of rotation substantially perpendicular to the plane in order to modify a position of an edge of the web in a direction of the positionable roll shafts. The frame is pivoted relative to the stationary rolls about a second axis of rotation one component of which runs parallel to a movement direction of the web between the positionable rolls.

19 Claims, 21 Drawing Sheets

U.S. PATENT DOCUMENTS

| | | | | |
|---|---|---|---|---|
| 4,291,825 | A | 9/1981 | Glanz | |
| 4,991,761 | A | 2/1991 | Gnuechtel et al. | |
| 5,021,673 | A | 6/1991 | Dragon et al. | |
| 5,323,944 | A | 6/1994 | Faust et al. | |
| 5,667,123 | A | 9/1997 | Fukuda | |
| 5,921,452 | A | 7/1999 | Wulf et al. | |
| 6,101,365 | A | 8/2000 | Nishikawa | |
| 6,104,907 | A | 8/2000 | Obata et al. | |
| 6,584,900 | B2 | 7/2003 | De Vroome | |
| 6,676,066 | B2 * | 1/2004 | Keel | 242/548 |

FOREIGN PATENT DOCUMENTS

| | | |
|---|---|---|
| DE | 689 07 466 | 10/1993 |
| DE | 44 35 077 | 11/1995 |
| DE | 195 20 637 | 12/1996 |
| DE | 196 24 639 | 9/1998 |
| DE | 199 53 353 | 5/2000 |
| DE | 199 60 649 | 6/2001 |
| DE | 101 36 696 | 2/2002 |
| EP | 0 367 368 | 5/1990 |
| EP | 1 153 868 | 11/2001 |
| FR | 2 659 426 | 9/1991 |

OTHER PUBLICATIONS

Patent Abstracts of Japan 02163255—Jun. 22, 1990.
Patent Abstracts of Japan 03061248—Mar. 18, 1991.
Patent Abstracts of Japan—03000409—Jan. 7, 1991.
Patent Abstracts of Japan—06239506—Aug. 30, 1994.

* cited by examiner

Z1
Z2
Z3
S1
S2
S3
S4
S5
S6
S7
S8
10
12
13
14
16
18
20
22
24
26
28
30
32
34
36
38
40
42
44
46
48
49
50
52
54
56
58
60
62
64

DEVICE AND METHOD FOR GUIDING A CONTINUOUS WEB BY MEANS OF A PIVOTABLE APPARATUS

BACKGROUND

The present preferred embodiment relates to devices for guiding an endless web as used for example in a printer or copier. The present preferred embodiment also relates to methods for guiding an endless web.

In the guiding of a paper web through a printer, non-uniform mechanical properties of the web or a basic setting of the various guide rolls that is not precisely parallel can result in a lateral shifting of the paper web, and can cause the formation of waves in some areas and/or sagging at one side of the web, even if the front edge is running in a stable fashion. At points of deflection with counter-pressure or back pressure rolls, as are, for example, required for transport, such waves can be pressed to form folds. In addition, sagging at one side of the web, for example in the area of a fixing station that operates in contactless fashion, is disturbing, because the sagging web segment can come into contact with mechanical parts, so that the toner images are smudged, or the sagging segment is exposed to an excessively high energy load.

From U.S. Pat. No. 5,021,673, a device is known for guiding a paper web in which for the guiding of the web, rolls are situated at both lateral edges that exert pressure on the web with different forces. In this way, a lateral shifting of the web can be corrected.

In U.S. Pat. No. 5,323,944, a device for controlling the lateral position of a web is described with which the web is guided between a pressure roll and a counter-pressure roll. The pressure roll can be pivoted, and the force exerted on the counter-pressure roll along its shaft or axle can be varied in order to shift the side edges of the web. The current position of the side edges of the web is acquired using optoelectronic sensors.

U.S. Pat. No. 6,104,907 describes a device for guiding a paper web in a printer. In order to avoid vibrations and variations in speed, the web is guided around rolls and is clamped by them, which also counteracts a lateral shifting of the web. For example, in order to avoid lateral shifting, a guide roll is used having pins that engage in corresponding holes in the web. In another variation, the force that a roll exerts along its axis on the web is varied. In another variation, the web is guided between pairs of upper and lower rolls. These upper and lower rolls wrap and clamp the web with an enlarged wrap angle, thus preventing a variation in speed of the web.

From documents DE 689 07 466 T2, DE-OS 14 24 318, DE 195 20 637, and DE 199 60 649 A1, web guiding devices are known for guiding an endless web. In addition, pivotable draw-off devices for paper webs are known from DE 199 53 353 A1 and DE 44 35 077 A1.

SUMMARY

An object is to indicate devices and methods that enable a precise guiding of an endless web, and with which a sagging at one side of the web is avoided.

In a method or device for guiding an endless web, the endless web is guided via a first positionable roll to an additional positionable roll with a predetermined angle of wrap on each roll, shafts of the rolls lying parallel to one another in a plane and being held by a frame. The web is fed to and led away from the positionable rolls via a respective first stationary roll and a respective additional stationary roll. The frame is pivoted relative to the stationary rolls about a first axis of rotation substantially perpendicular to the plane in order to modify a position of an edge of the web in a direction of the positionable roll shafts. The frame is pivoted relative to the stationary rolls about a second axis of rotation one component of which runs parallel to a movement direction of the web between the positionable rolls.

DESCRIPTION OF THE PREFERRED EMBODIMENT

Figures 1A, 1B:
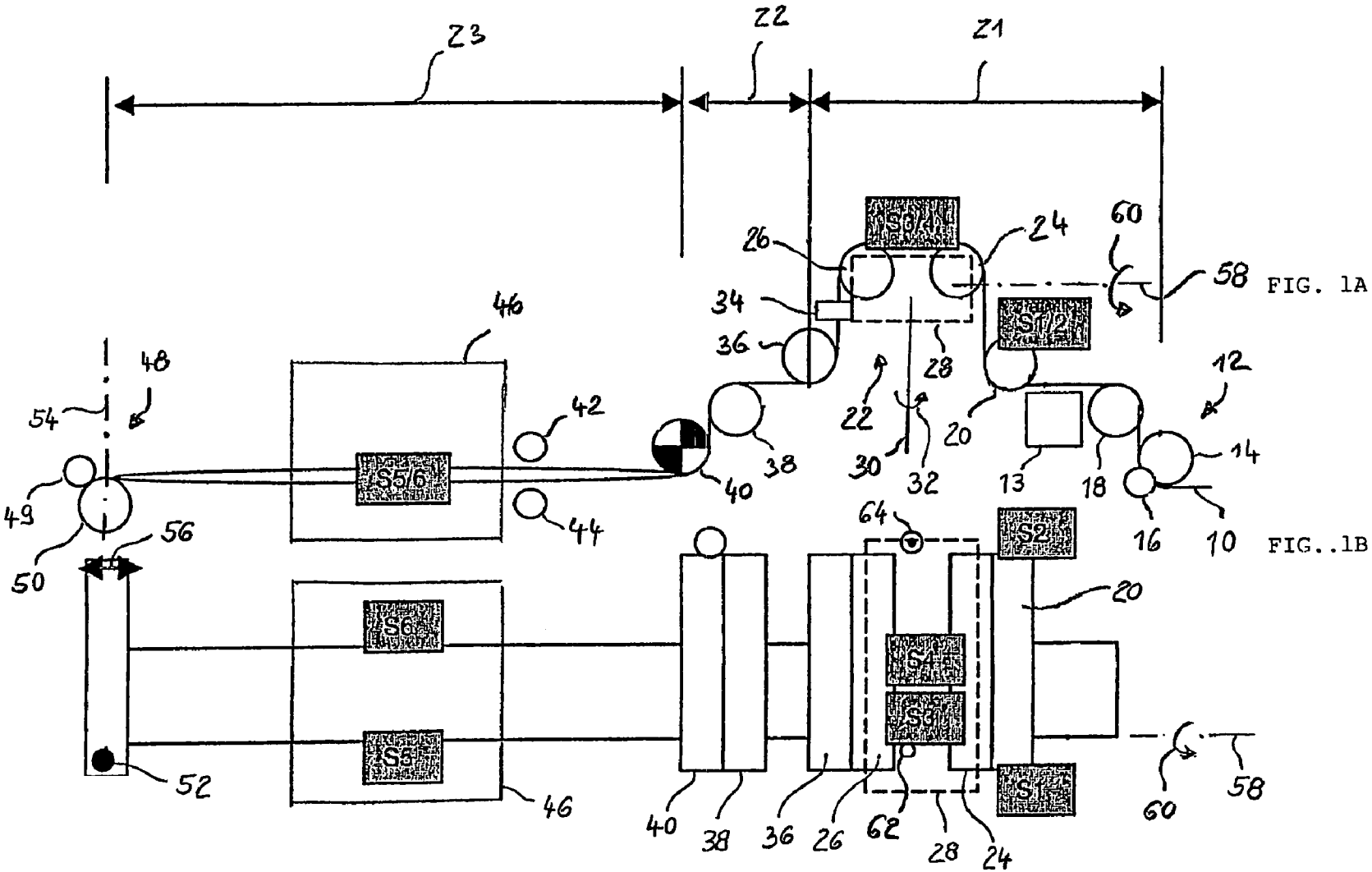
FIGS. 1A and 1B are respectively side and plan views as schematic representations of the paper transport device in a high-performance printer, having a rotating frame that can be moved in two axes of rotation and a pivotable draw-off device.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

According to this solution, the endless web is guided via two rolls with a predetermined wrap angle for each roll. The shafts of the rolls are situated parallel to one another in a plane and are held by a frame. The frame can be pivoted about a first axis of rotation essentially perpendicular to this plane in order to modify the position of the edge of the web in the direction of the roll shafts. In this way, a lateral shifting of the web can be corrected. In addition, the frame can be pivoted in a second axis of rotation having one directional component in three-dimensional space that runs parallel to the direction of movement of the web between the two rolls. In this way, the web tension can be modified on one side of the web, so that a sagging of the web at one side is avoided. The second axis of rotation can also run exclusively parallel to the direction of movement of the web. The additional components in three-dimensional space then relate to the zero direction of movement. However, constructive advantages result from an oblique positioning of the axis of rotation in relation to the direction of movement, where only one component need run parallel to the cited direction of movement.

According to a further aspect of the preferred embodiment, a method is indicated for guiding an endless web.

FIGS. 1A, 1B schematically shows the transport of an endless paper web 10 through a high-performance printer. In the upper half FIG. 1A, a side view is schematically shown, and in the lower half of the Figure a top view is shown. The web transport through the printer takes place in three zones Z1, Z2, and Z3. In zone Z1, paper web 10 is conveyed through a pull-back device 12 that contains a roll 14 and a counter-pressure roll 16. Pull-back device 12 is used to give paper web 10 a predetermined tension in the direction of transport. Paper web 10 is subsequently deflected at a deflector roll 18 and is supplied to an inlet roll 20 that is positioned before a rotating frame 22, as seen in the direction of transport. Inlet roll 20 comprises two sensors S1, S2 for measuring the tensile force on the web, as is explained in more detail below. Rotating frame 22 contains two positionable rolls 24, 26 whose shafts are parallel to one another and are held by a frame 28 shown in broken lines. Frame 28 can be pivoted about an axis of rotation 30 in the direction of arrow 32. The web transport system is monitored by two sensors S3, S4 that monitor paper web 10 from above in the area between positionable rolls 24, 26. Alternatively, the web 10 can also be monitored from below using corresponding sensors.

In the output area of rotating frame 22 an edge sensor 34 is situated fixedly on the device that determines the actual position of the side edge of paper web 10. Dependent on the actual position and the deviation of the edge from a target position, rotating frame 22 is pivoted on a framework about axis 30, so that the side edge is controlled to a predetermined target position.

As seen in the direction of transport of paper web 10 after rotating frame 22 in zone Z2, there is situated a stabilizing roll 36 that acts to compensate the tension in paper web 10. Stabilizing roll 36 can be slightly flexible or yielding radially, thus effecting a passive compensation for web 10. In addition, a deflecting roll 38 and a drive roll 40 are situated in this zone Z2. Drive roll 40 exerts a tensile force on paper web 10 and transports web 10 forwards against the resistance of a braking device 13, e.g. a vacuum brake. Drive roll 40 determines the speed with which paper web 10 is transported forwards. Alternatively, pullback device 12 can be used as a permanent brake.

In zone Z3, paper web 10 is printed on one or both sides at transfer rolls 42, 44. Web 10 subsequently passes through a fixing station 46 in which the toner images applied to web 10 are fixed, for example by infrared fixing. In the area of fixing station 46 there are situated sensors S5, S6 that monitor paper web 10. At the end of zone Z3 there is situated a draw-off device 48 having rolls 49, 50 that draw off web 10 with a predetermined tensile force.

In the case of limited infrared fixing, paper web 10 must not come into contact with mechanical parts between draw-off device 48 and transfer rolls 42, 44, in order to avoid smudging of the toner image. Sagging at one side of the paper web must therefore be stopped.

Draw-off device 48 can be pivoted in the direction of double arrow 56 about an axis of rotation 54 that passes through rotation point 52. In this way, the tension can be varied along the two side edges 11, 13 of paper web 10, in order to reduce or to prevent a sagging at one side of paper web 10.

Rotating frame 22 can additionally be pivoted in a second axis of rotation 58 in the direction of arrow 60. Axis 58 runs essentially parallel to or identical to the direction of movement of paper web 10 between the two positionable rolls 24, 26. In this way, the tension on one side of paper web 10 can be increased or decreased, thus avoiding a sagging comprising movement in a direction perpendicular to a plane of the web at one side of paper web 10.

In the lower part FIG. 1B, a top view of the transport of paper web 10 through the high-performance printer is shown. In a variation, the transport of paper web 10 takes place in such a way that one side edge has a fixed target position independent of the width of paper web 10. In the present example, this has been determined to be the left side edge 11, seen in the direction of transport. This side edge 11 agrees with second axis of rotation 58. In the present example according to FIG. 1, a pivoting of the entire rotating frame 22 takes place about axis of rotation 58 by pivoting frame 28 about a bearing 62 that is situated approximately below the prolongation of axis of rotation 58. For this purpose, a screw-nut combination 64 is situated on the opposite side of bearing 62, with which frame 28 can be pivoted about axis of rotation 58. It is to be noted that other determinations of side edge 11 in relation to axis of rotation 58 can be made. Other devices can also be used for the pivoting that operate electrically, hydraulically, or pneumatically. The depicted screw-nut combination 64 merely indicates a particularly simple device that can be actuated by hand.

Sensors S1, S2 are preferably formed as force sensors, and measure the forces exerted by paper web 10 on the shaft of inlet roll 20. If the force on one side of web 10 is reduced, the typical result is a sagging of web 10 at this side. A sagging at one side of this sort can be compensated by adjusting screw-nut combination 64.

In the one-sided determination of side edge 11 of web 10 shown in FIGS. 1A, 1B, web 10 is not situated centrically in relation to inlet roll 20. This asymmetry also has the result that, due to different lever arms, asymmetrical forces occur in sensors S1, S2 along the shaft of inlet roll 20. Here, the target values for a correction that may be required are likewise asymmetrical. They are determined for example using computer programs or by measurements, and form the basis for corrective data.

Sensors S3, S4 and S5, S6 monitor the edge areas of web 10 having side edges 11, 13, and can recognize a sagging at one side. For example, video cameras can be used as sensors. Another possibility is to acquire the web tension in the area of side edges 11, 13, for example using one or more force sensors. Another possibility is to determine the sagging of the respective side edge 11, 13 using path sensors that operate optically, inductively, and/or capacitively.

Figure 2:
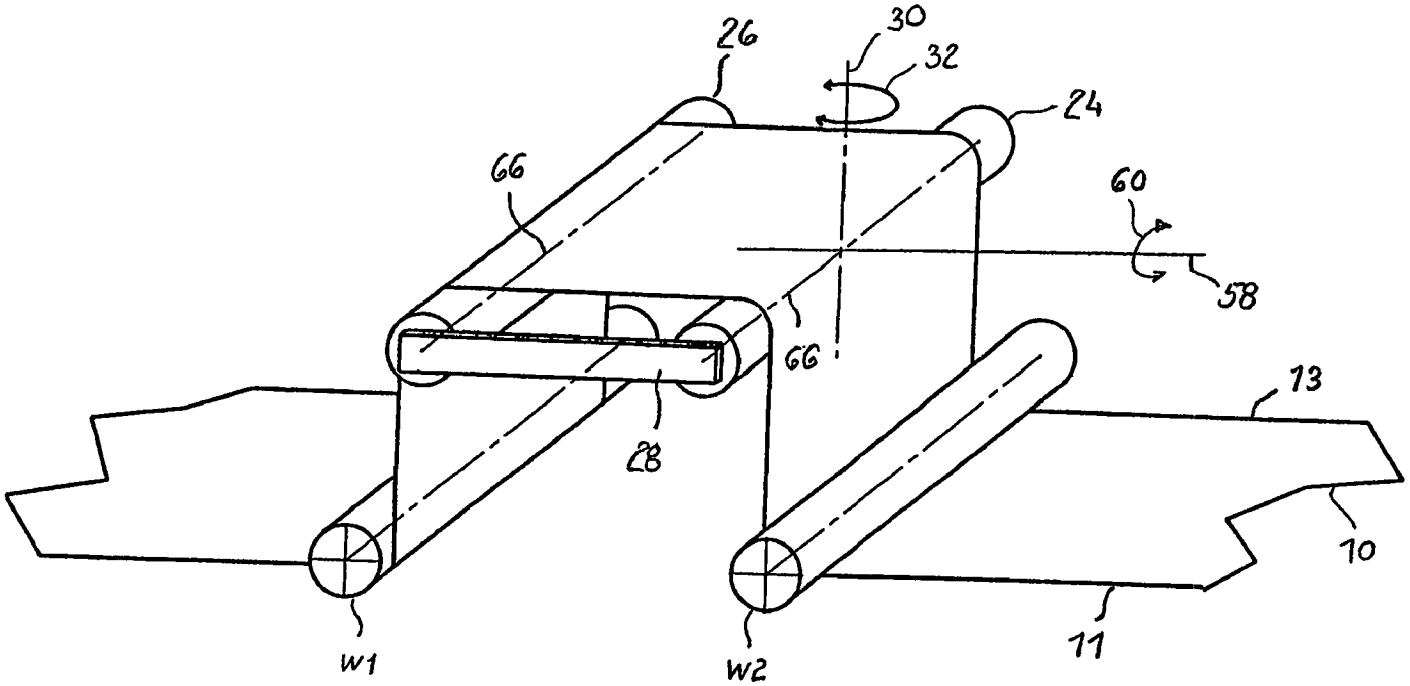
FIG. 2 shows the design of the rotating frame.

FIG. 2 schematically shows rotating frame 22 having two rolls 24, 26, whose shafts 66 run parallel to one another and are held by frame 28. Through a rotation in the direction of arrow 32 about axis 30 in relation to stationary rolls W1, W2 (inlet roll 20 and stabilizing roll 36 in FIGS. 1A, 1B), the position of side edges 11, 13 of web 10 can be modified in the direction of roll shafts 66. Through a pivoting in the direction of arrow 60 about axis 58, the tension within paper web 10 can be modified at the side of an edge 11, 13 of the web. In the example according to FIG. 2, axis of rotation 58 is situated in the center of web 10. However, it can also be situated at the edge of web 10, as in the example according to FIGS. 1A, 1B, or even outside paper web 10.

Figure 3:
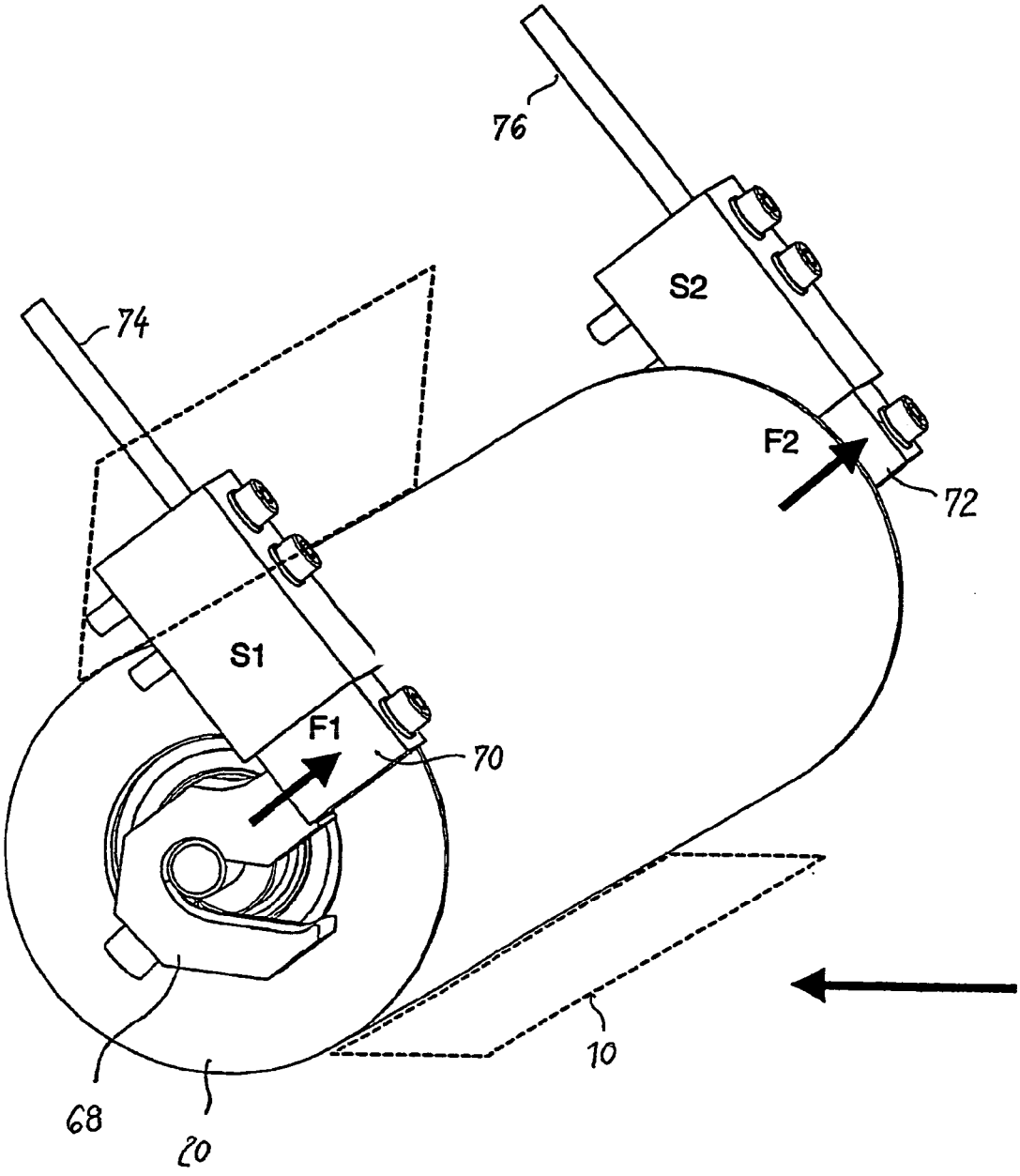
FIG. 3 shows an inlet roll with web tension measurement.

FIG. 3 shows an example of the measurement of the tension of paper web 10 using draw-in roll 20 and sensors S1 and S2, which are realized as bending beams with expansion measurement strips for force measurement. Inlet roll 20 is held at both ends in receptacles 68. These receptacles 68 are connected fixedly with the printer housing (not shown) by means of mounts (bending beams) 70, 72. The expansion measurement strips of sensors S1, S2 measure the bending of these mounts 70, 72, and thus the forces F1, F2 that occur at each side of draw-in roll 20, which, given an asymmetrical situation of paper web 10 and draw-in rolls 20, are approximately proportional to the tension in each side edge 11, 13 of paper web 10. Sensors S1, S2 provide electrical signals via lines 74, 76. If the web tension in the area of a side edge 11, 13 of web 10 is less than the target value, the respective force F1, F2 is also less than the target value, so that a sagging of this side edge 11, 13 of web 10 can be inferred. Given an asymmetrical situation of paper web 10 and draw-in roll 20, the lever arms for sensors S1, S2 along the shaft of inlet roll 20 are to be taken into account, i.e., the target forces are likewise asymmetrical and the forces are to be corrected accordingly.

The depicted measurement of the tension of paper web 10 at draw-in roll 20 can of course also be applied at other rolls in the web transport through the printer, so that using a similar system it is possible to determine sagging at one side of web 10 at almost any location within the printer.

Figure 4:
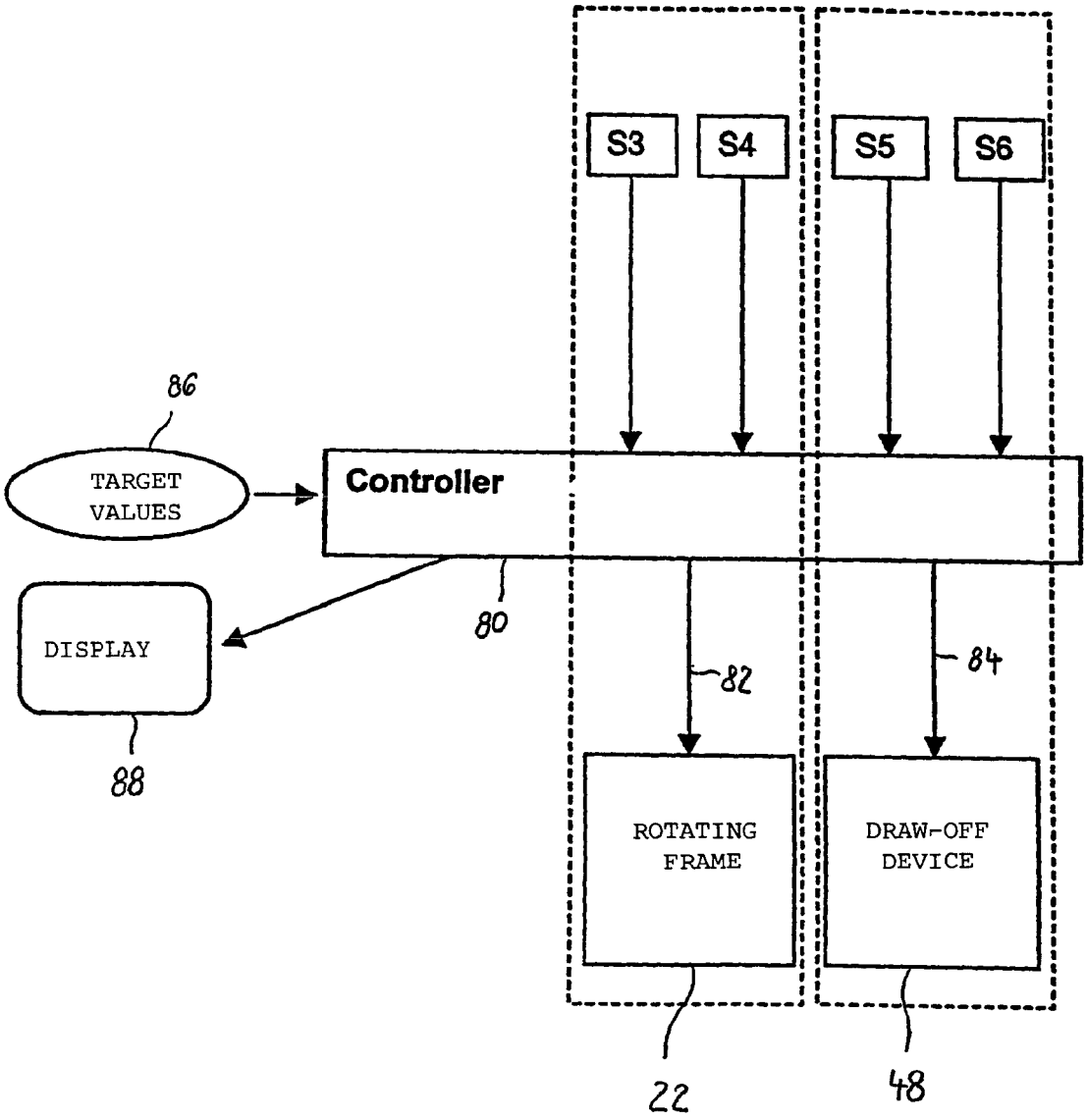
FIG. 4 shows a schematic representation of the controlling of the web transport device according to a first variation.
Figure 5:
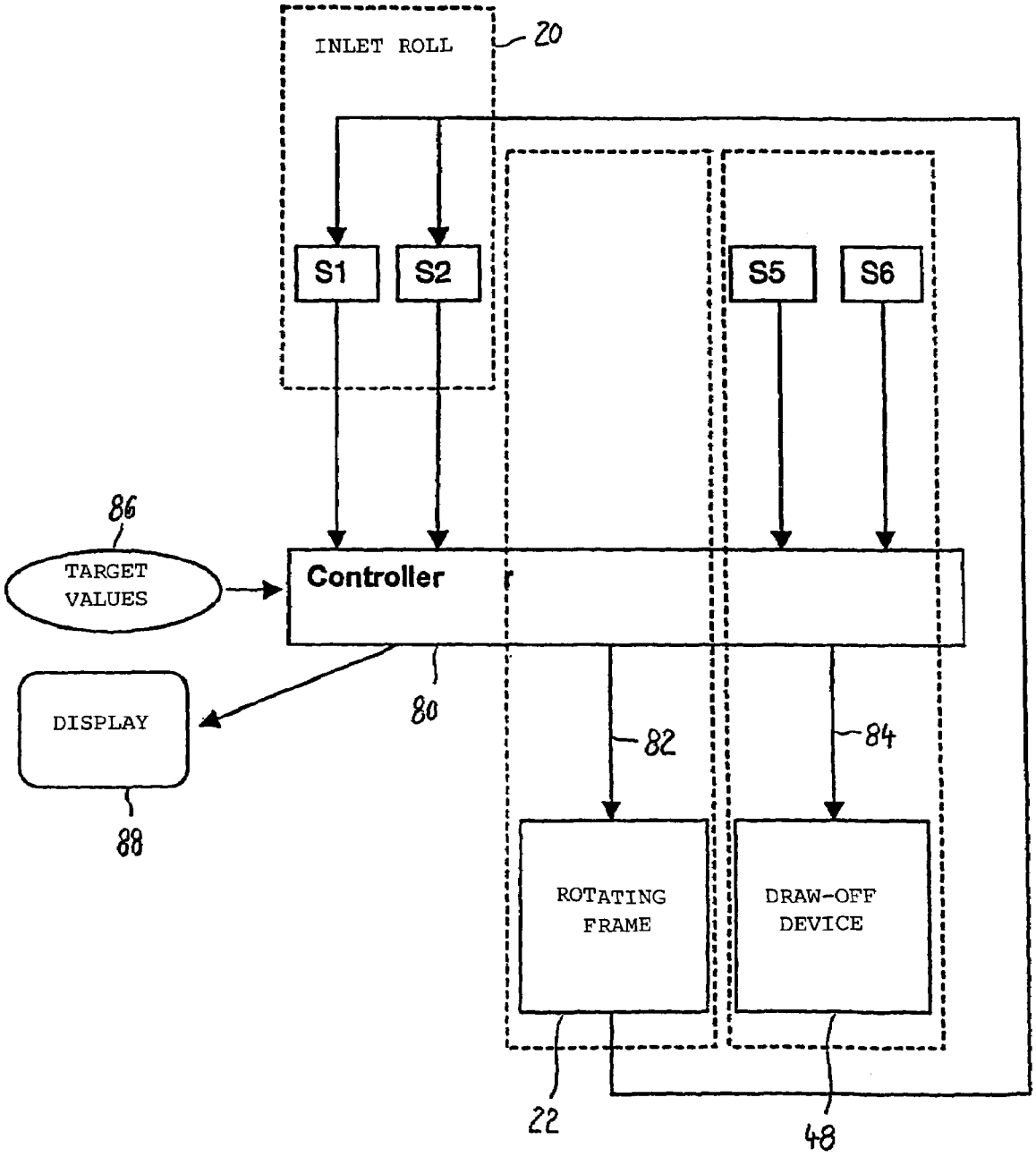
FIG. 5 shows a second variation of a control system.
Figure 6:
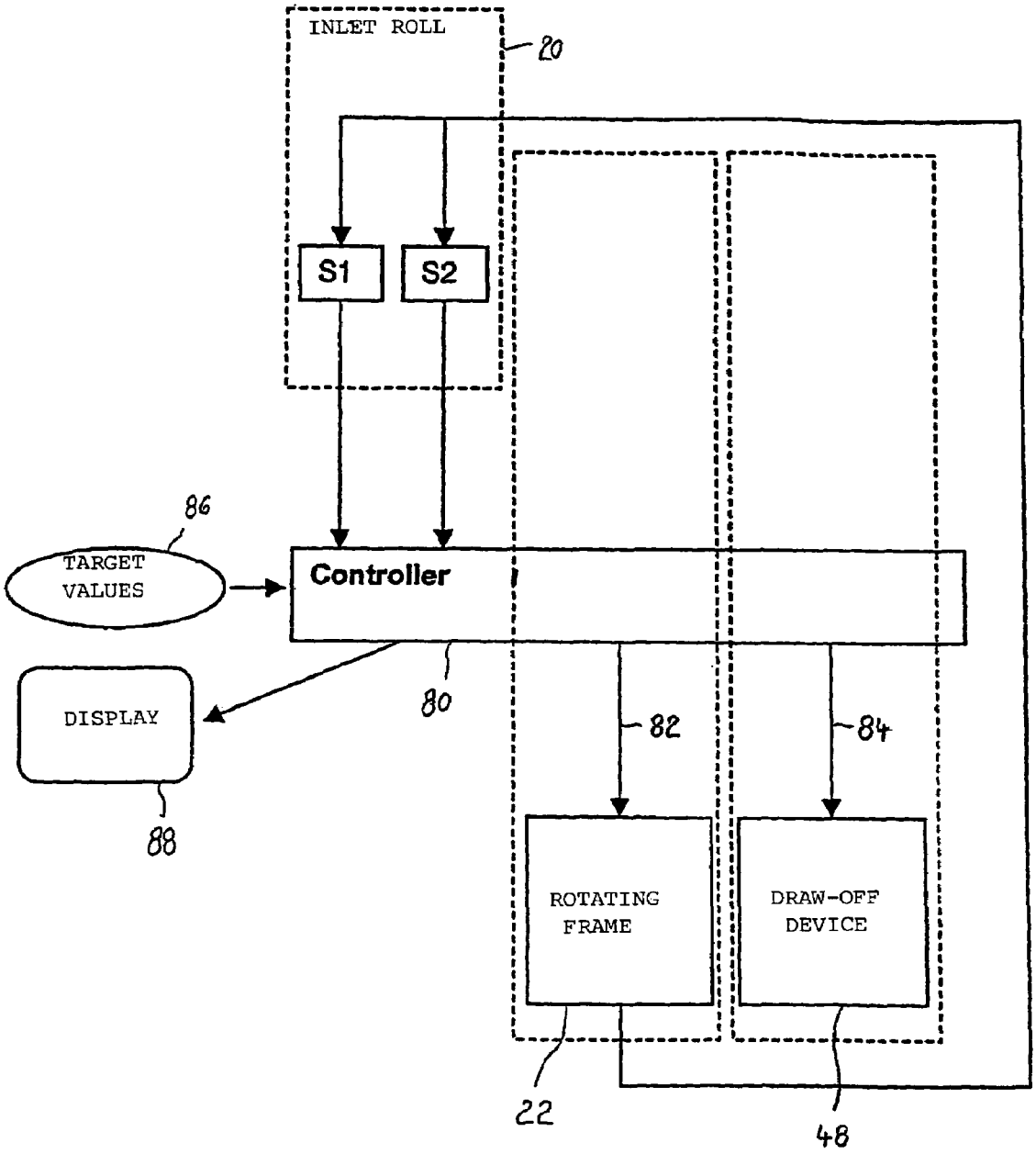
FIG. 6 schematically shows a control system according to a third variation.

FIGS. 4, 5 and 6 show three variations for controlling or regulating the web tension in the printer. In the variation according to FIG. 4, a controlling or regulating of the web tension takes place using sensors S3, S4 on rotating frame 22 as well as sensors S5, S6 in the area of fixing station 46. The signals of sensors S3, S4 and S5, S6 are provided to a control unit 80 that processes them preferably by means of software, in a control or regulation algorithm. This control unit 80 then produces control signals 82, 84 for controlling corresponding drives for rotating frame 22 and for draw-off device 48. The control algorithm processes predetermined target values 86; control unit 80 also produces items of information concerning operating states that are shown on display 88.

If it has been determined with the aid of sensors S3, S4 that in the area of rotating frame 22 web 10 is sagging along a side edge 11, 13, rotating frame 22 is pivoted about axis of rotation 58, for example using an electrically actuated screw-nut combination 64 or using other pivot mechanisms. In this way, paper web 10 is made rigid in the sagging area. In a similar manner, a sagging at one side in the area of fixing station 46 is acquired by sensors S5, S6 and is counteracted and/or completely compensated by pivoting draw-off device 48 about axis of rotation 52 along double arrow 56. In this way, a sagging at one side is also corrected in the area of the fixing. In the described first variation, a sagging at one side in the area of rotating frame 22, as well as in the area of fixing station 46, is thus corrected. This can take place using control algorithms that are stored in the control unit. However, a regulating can also take place in such a way that target values are pre-indicated to the control unit and are compared with actual values from sensors S5, S6 and S3, S4; any deviation is corrected by adjusting rotating frame 22 or draw-off device 48.

In the second variation according to FIG. 5, in which identical parts have identical reference characters, for the correction of the web tension the signals of sensors S1, S2 in the area of draw-in roll 20 and sensors S5, S6 in the area of fixing station 46 are evaluated. With the aid of the signals from sensors S1, S2, a web tension that is lessened along one edge 11, 13 of paper web 10 can be detected, which is interpreted as a sagging at one side of paper web 10. Rotating frame 22 is then controlled so as to counteract this decreasing of the tension at this side of web 10. By means of a control algorithm, the pivoting of rotating frame 22 about axis of rotation 58 takes place in such a way that predetermined forces are achieved for sensors S1, S2. The setting of the web tension with the aid of sensors S5, S6 takes place as described in relation to the variation according to FIG. 4. In this variation as well, a sagging of the paper web at one side is corrected or avoided in the area of rotating frame 22 and in the area of fixing station 46.

In the variation according to FIG. 6, a monitoring of paper web 10 takes place only with the aid of sensors S1, S2, which are situated in the area of draw-in roll 20. Assuming that the axes of all the conveyor rolls for transporting the paper web are in a basic setting in which they are parallel to one another, a sagging at one side of paper web 10 can be caused only by non-uniform mechanical characteristics of paper web 10. The signals from sensors S1, S2 thus provide diagnostic information about the characteristics of the web, for example as to whether the web is curved, or has a varying density, or has varying tensions along the axes of its surface. With the aid of empirical values determined from trials and measurements, for each tuple of values of sensors S1, S2, in which the web width and type of paper are also taken into account, an associated deflection of rotating frame 22 about axis 58 and/or an associated deflection of draw-out device 48 about axis of rotation 52 can take place. Typically, such tuples of values, and the associated control parameters for the required deflection for the rotating frame and for draw-off device 48, are stored in a memory as a table. In this variation, the expense for sensors is minimal, but a high-quality guiding of the paper web in the printer is achieved nonetheless. Of course, the described variation according to FIG. 6 can also be combined with the variations according to FIG. 4 or FIG. 5, i.e., the signals of sensors S3, S4 and/or S5, S6 can also be used for the controlling and regulation of paper web 10.

According to a fourth variation, a monitoring of the web tension and a correction take place only in the area of fixing station 46, in order to avoid a harmful sagging at one side of the paper web. With the aid of the signals from sensors S5, S6 and pivotable draw-off device 48, a stable web guiding is achieved for the relatively long path of a fixing station 46 operated with infrared radiation.

Figure 7:
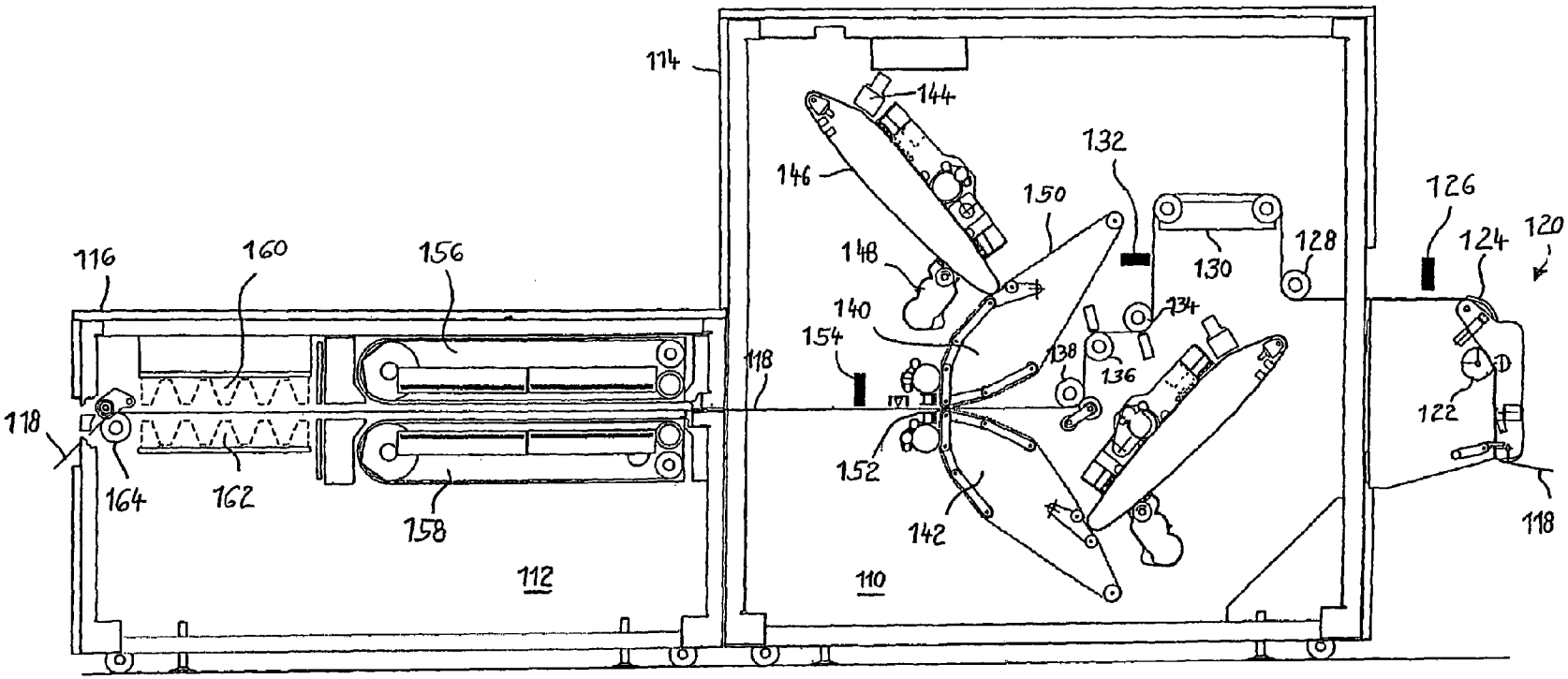
FIG. 7 shows the design of an electrographic printer in which a web guiding system is realized.

In FIGS. 7 to 13, according to a further aspect of the preferred embodiment examples are described that can also be combined with the examples described above. FIG. 7 shows a high-performance printer in which the device and method according to the preferred embodiment are realized. The printer is divided into a printing mechanism 110 and a fixing station 112, each having an independent housing 114, 116 that are connected to one another. A web 118 of endless paper is fed through both housings 114, 116. In a web inlet area 120 for printing mechanism 110 there is situated a web pull-back motor 122 that exerts a retaining force on web 118 with the aid of a pair of rolls. In addition, a web brake 124 is provided that smoothes web 118 and likewise exerts a retaining force on web 118. Web brake 124 is, for example, realized by a piece of felt that lies against web 118. Another possibility is to use a vacuum brake. Here, a variable vacuum is used to apply a vacuum, i.e. suction, to the underside of the web, and the frictional force is modified accordingly. In the web inlet area of pull-back device 120, or, more precisely, just after (seen in the normal direction of transport) web brake 124, a second sensor 126 is situated that acquires the actual position of the side edge of web 118.

Via a deflecting roll 128, web 118 is supplied to a rotating frame 130 that acts as an actuating element for shifting the position of the side edge of web 118. Rotating frame 130 executes rotational movements about an axis situated perpendicular to web 118, thereby shifting the side edge in a direction perpendicular to the plane of the paper in FIG. 7. In the outlet area of rotating frame 130 there is situated a first sensor 132 that acquires the actual position of the side edge of web 118. Via two additional deflecting rolls 134, 136, web 118 is supplied to a web drive 138 that contains a roll pair. Web drive 138 moves web 118 forward in the direction of transport, against the retaining force of web brake 124.

Further along the transport path, an upper transfer print station 140 and a lower transfer print station 142 are situated at both sides of web 118. Both transfer print stations 140, 142 print toner images simultaneously on the upper and lower sides of web 118. The two transfer print stations 140, 142 are essentially identical in construction; for this reason, only upper transfer print station 140 is explained in more detail below. Upper transfer print station 140 comprises a character generator 144 that produces an electrostatic charge image on a photoconductor belt 146, corresponding to a print image that is to be printed. An upper developer station 148 colors in the electrostatic charge image with toner material; the toner images are then transferred onto a transfer belt 150. Further along, the toner images situated on transfer belt 150 are then transferred onto web 118 at transfer point 152; that is, at transfer point 152 toner images are transferred simultaneously by both transfer print stations 140, 142.

Seen in the direction of transport, after transfer point 152 there is situated a third sensor 154 that also acquires the actual position of the side edge of web 118. The not-yet-fixed toner images on web 118 are supplied to fixing station 112, where they are fixed and cooled on both sides of the web in infrared fixing devices 156, 158 and subsequent fans 160, 162. In the outlet area of fixing station 112 there is situated a web draw-off motor 164 that acts on a pair of rotating rolls and that conveys web 118 out of fixing station 112.

The depicted high-performance printer has various operating states in which different tasks occur that relate to controlling the position of the side edges of web 118:

Operating State 1: Automatic Web Placement or Insertion

When a new web 118 is put into place, with the aid of a clamp it is automatically passed through printing mechanism 110 and through fixing station 112, and from there is transported to the web outlet. During the guiding of web 118 with the aid of the clamp, rotating frame 130 and the position controlling system remain inactive. After the putting into place of the web has been completed, rotating frame 130 and the position controlling system are activated.

Operating State 2: Placement of a Glued-on Web

If a new web is glued onto a previous web, the new web is guided through printing mechanism 110 and fixing station 112 with a transport speed that is significantly less than the normal print speed, in order not to overload the glued point. During the transport of the glued point through the printer, a controlling adapted to the slow transport speed is active. Positional deviations at the side edge can occur as a result of the glued point between the old web and the new web. The controlling task here is to cause the side edge of web 118 to settle into a target position as quickly as possible. After the web has been put into place, the normal positional controlling is activated.

Operating State 3: Slow Forward Transport and Backward Transport of the Web

In order to position the web as precisely as possible when pre-printed paper (form paper) is being put into place, a slow forward and backward transporting is required. During this positioning, the control device and rotating frame 130 are not active. After this fine positioning is terminated, the following movement of the paper activates the controlling and the rotating frame 130, and the side edge of web 118 should be brought into the target position as quickly as possible (as in operating states 4 and 5 described below). In this process, it is important that there be as few wasted sheets as possible.

Operating State 4: Rapid Forward Transport Without Print Operation

At the end of a print job, the side edge of the web should be held in the target position with a defined printing speed, but without printing operation, so that the last-transferred toner images can be fixed in fixing station 112. At the end of the forward motion of web 118, a backward motion is introduced so that a new beginning of the operation can be carried out in a correct relation to the form; that is, the print images must be printed on web 118 with a precise positioning in relation to a form. During this forward and backward movement of the web, the controlling and the rotating frame 130 are active; the target position of the side edge of the web should be achieved as quickly as possible, resulting in only a few wasted pages.

Operating State 5: Web Transport in Print Operation

At the start of the print operation, web 118 is first brought to the target speed, corresponding to the print speed, with transfer stations 140, 142 pivoted away. The transfer stations with the transfer belts are subsequently pivoted into place and print operation takes place. At the end of a print operation with forward movement of the web, a backward transport of web 118 is carried out with pivoted-away transfer stations, so that a new beginning of the print operation can take place with a correct positioning in relation to the form. In this operating state the controlling and the rotating frame 130 are active. A rapid settling of the side edge into the target position should take place within the various transport speeds of web 118.

Figure 8:
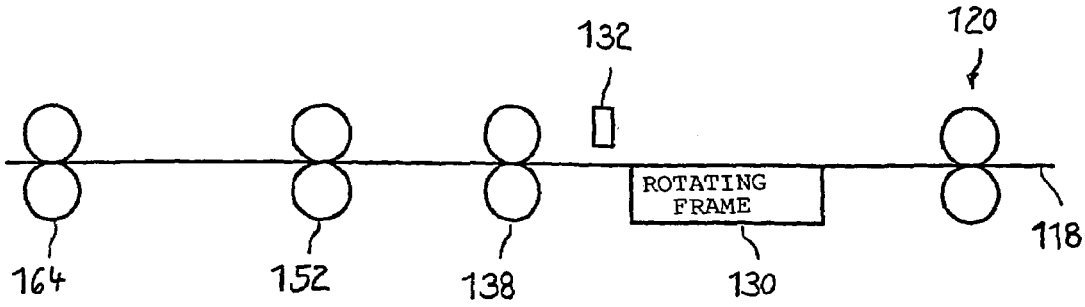
FIG. 8 shows a schematic arrangement having a first sensor for acquiring the side edge of the web.

On the basis of a first example having only one sensor 132, FIG. 8 schematically shows the path of web 118 inside devices 110, 112 that is necessary for controlling the position of the side edge. Web 118 is conveyed through web inlet area 120, symbolized by a pair of rolls, to rotating frame 130, in whose web outlet first sensor 132 is situated. Web 118 is subsequently guided along web drive 138, transfer point 152, and draw-off device 164.

Figure 9:
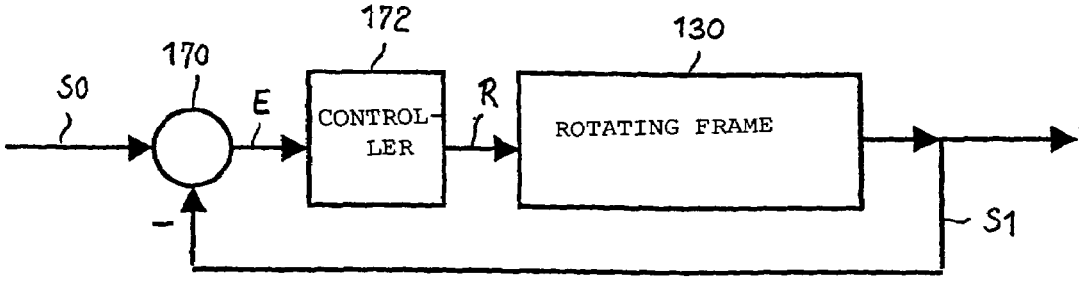
FIG. 9 shows a block diagram of the control circuit for controlling the position of the side edges.

FIG. 9 shows a block diagram of the position controlling system for the first exemplary embodiment. Actual signal S1 from first sensor 132 is supplied to an adder element 170, and control deviation E is formed. A controller 172, for example a PID controller, produces a control signal R that is supplied to rotating frame 130 as actuating element 130. On the basis of control signal R, rotating frame 130 modifies its angle of rotation, thus modifying the lateral position of the side edge of web 118. The actual position of the side edge is acquired by first sensor 132 as actual signal S1, which, as mentioned, is fed back to adder element 170. This control process continues to take place until control deviation E is equal to zero. The target position and target signal S0 are defined at the location of first sensor 132 as an electrical signal.

First sensor 132 determines measurement values at predetermined intervals along the path of web 118. A mean value of these measurement values is used as actual signal S1. Preferably, a sliding mean value or an exponential mean value is used as the mean value. In the case of a sliding mean value, first a mean value is formed from n measurement values. For each new measurement value that is added, a new mean value is calculated from the previous mean value and the new measurement value. Target value S0 can be determined in a similar manner in a calibration process. Preferably, the mean value is determined over a predetermined length of the web, in general a whole-number multiple of a standard format length of a print page. Typically, the 12-inch format is used as a standard format length, and the multiple factor is preferably 3.

Due to the mean value formation, short-waved positional deviations along the edge of the web do not result in undesirable deflections of the rotating frame. Moreover, due to the mean value formation, excessive positional deviations, caused by resonance, at the transfer printing point are avoided. Such positional deviations caused by resonance can occur in paper webs having side edges cut in the form of waves. Due to the calibration to the standard format length, waviness does not occur along printed lines in print images in the direction of transport of the web within a form length.

In this first exemplary embodiment, it can be problematic that the actual position agrees with the target position of the side edge only at the location of first sensor 132, i.e., in the vicinity of rotating frame 130. At transfer point 152, which is essential for the print quality, the side edge of web 118 can again deviate from a target position. As a result of the mean value formation, moreover, the settling-in or response characteristic can be relatively slow. In addition, due to the mean value formation a control deviation can remain permanently, because maximum amplitudes are not removed by the controlling.

Figure 10:
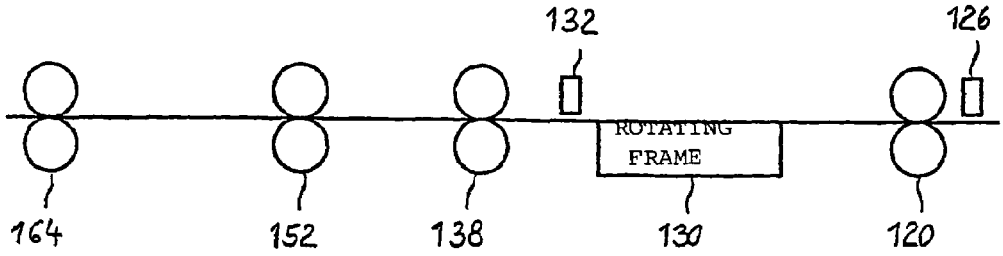
FIG. 10 shows a schematic design with an additional second sensor in the feed-in area of the web.

FIG. 10 shows a further exemplary embodiment having two sensors. Identical parts are designated with identical reference characters. Second sensor 126 is situated in web draw-in area 120. The rest of the system agrees with the one shown in FIG. 8.

Figure 11:
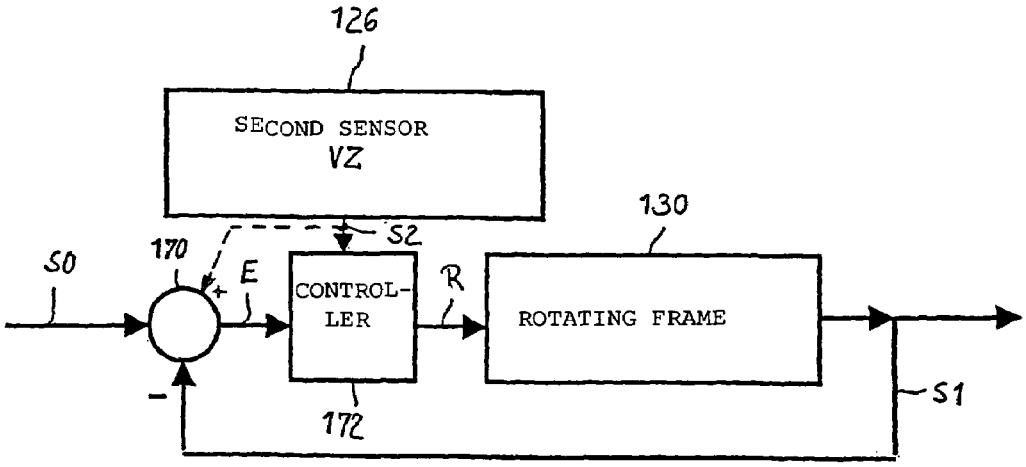
FIG. 11 shows a block diagram of the position control system having two sensors.

FIG. 11 shows a block diagram of the associated position control system for the side edge of web 118. With the aid of signal S2 from second sensor 126, controller 172, which outputs control quantity R to rotating frame 130, is influenced. Second sensor 126 represents, in its signal S2, the deviation of the position of the side edge of web 118 in web draw-in area 120, i.e., it determines the deviation of the actual position of the side edge from a target position in the area of web brake 124 (cf. FIG. 7). For this purpose, it is useful that in web draw-in area 120 there is situated a web feed-in device that comprises a lateral stop (not shown) along which the relevant side edge of web 118 is guided. In this way, a stable initial situation for the side edge of the web is created in the draw-in area of web 118.

Second sensor 126 preferably contains a delay element VZ. The delay time for signal S2 corresponds to the time required for web 118 to be transported from the location of second sensor 126 to the location of first sensor 132. In this way, the deviation of the side edge from a target value in web draw-in area 120 can be compensated in a time-delayed manner. Thus, the deviation of the side edge from a reference value in the web draw-in area is determined, and as a first alternative, signal S2 is added to target value S0 (shown in broken lines in FIG. 11). As a second alternative, signal S2 is applied directly to controller 172, which forms control quantity R, taking into account this signal S2. In this exemplary embodiment according to FIG. 11, no mean value formation is carried out for signal S1 of first sensor 132, because this would disturb the compensation using signal S2.

The advantage of the positional controlling according to FIG. 11 is that only the long-waved deviations of the mean actual position of the side edge from a target position at the location of first sensor 132 are compensated by rotating frame 130. Due to the taking into account of a deviation of the side edge in the draw-in area of web 118, the startup or response characteristic of the control circuit is relatively fast. In this example according to FIG. 11, it is also to be noted that the control deviation at the location of first sensor 132 can be minimal, but at the location of transfer point 152 deviations from an optimal position of the side edge can nonetheless occur.

Figure 12:
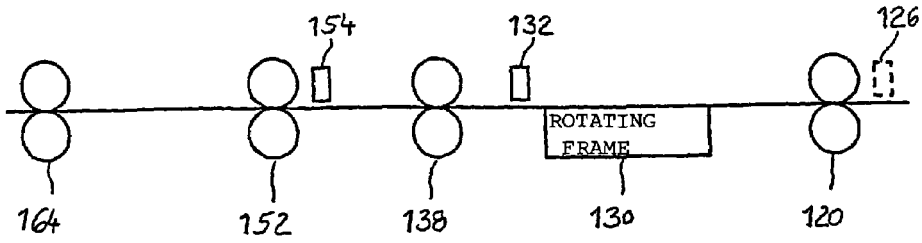
FIG. 12 shows the design with three sensors.

FIG. 12 schematically shows the design having three sensors 126, 132, and 154. Second sensor 126 is optional, as is indicated by broken lines. Third sensor 154 is situated within an area of ±100 mm relative to transfer point 152 of transfer stations 140, 142, because transfer point 152 itself is difficult to access.

Figure 13:
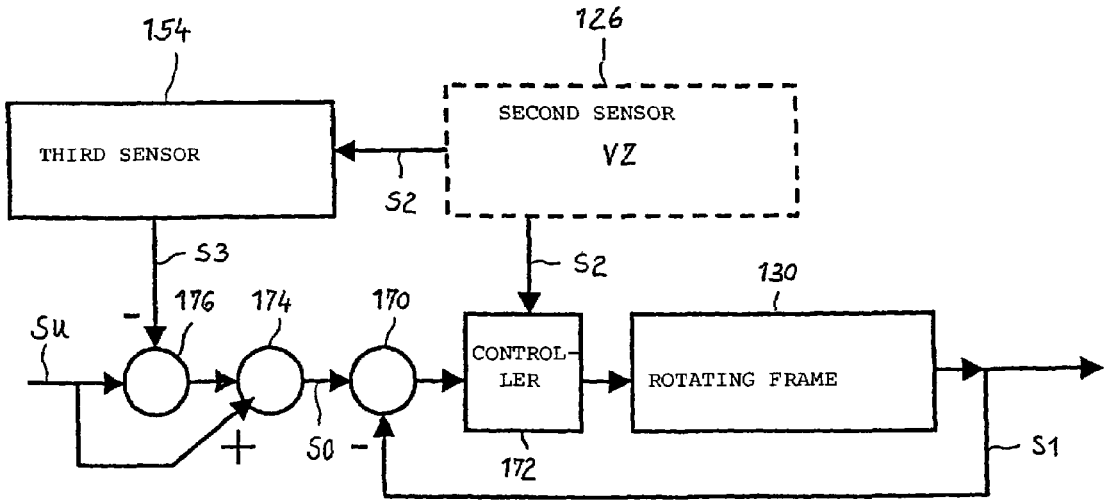
FIG. 13 shows the block diagram of the position control system in which the signals of the three sensors are taken into account.

FIG. 13 shows the associated positional controlling using signals S1 of the first sensor, S3 of the third sensor, and, optionally, signal S2 of the second sensor. The positional control system contains, in addition to addition element 170, addition elements 174 and 176. Addition element 176 is supplied with signal SU, which reproduces the target position at sensor 154, i.e., in the vicinity of transfer point 152. Addition element 176 carries out the target value/actual value comparison between signals SU and S3. The result is supplied to addition element 174, whose result is in turn supplied to addition element 170. At addition element 170, actual value S1 of first sensor 132 in the area of rotating frame 130 is taken into account. As in the example according to FIG. 5, the signal of second sensor S2 can optionally be taken into account as a delayed signal at controller 172 or at addition element 170 (this variant is not depicted). Optionally, signal S2 can also be taken into account in the formation of signal S3, i.e., signal S2 acts on third sensor 154.

With the aid of the controlling according to FIG. 13, it is possible to take into account the positional deviation directly at transfer point 152. Signal S3, possibly also taking into account signal S2, forms, after combination in adder elements 176 and 174, target signal S0 for the control circuit containing addition element 170. In order to keep the control system free of oscillations, signal S0 must change only slowly, for example more slowly than signal S1 by a factor of 110. The advantage of the arrangement according to FIG. 13 is that a deviation of the side edge in the area of transfer point 152 is also recognized and is controlled out by rotating frame 130.

Figure 14:
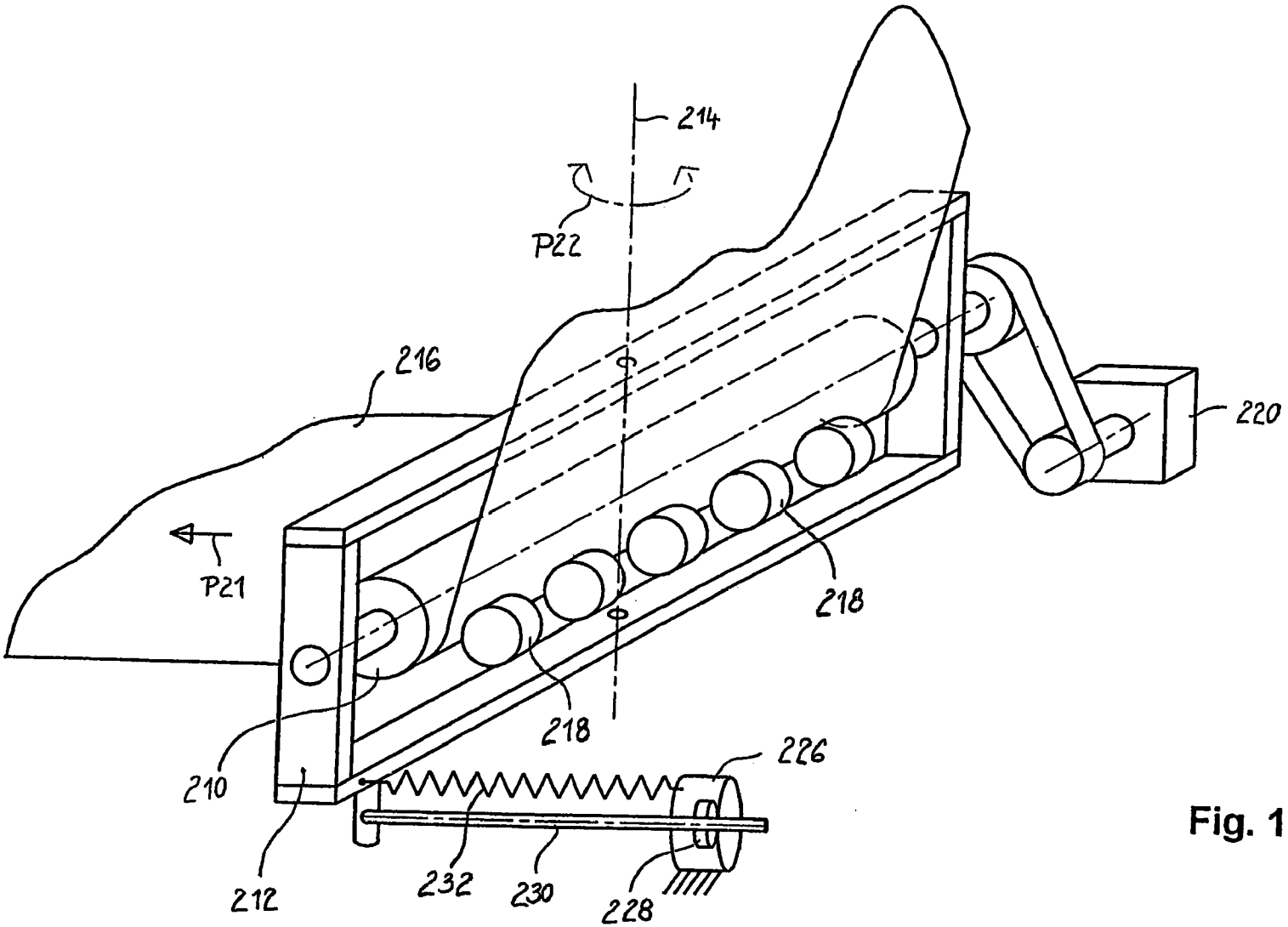
FIG. 14 shows a rotating frame having a single driven roll and counter-pressure rolls.

In the following FIGS. 14 to 24, examples of a rotating frame are shown according to a further aspect of the present invention. These examples can be combined with the previously described examples. In FIG. 14, a web guiding device is shown that has a single driven roll 210 mounted in a rotating frame 212. Rotating frame 212 can be pivoted about an axis of rotation 214 that runs essentially perpendicular to drawn-off web 216. Within rotating frame 212, counter-rolls 218 are also mounted that press web 216 against roll 210 with a predetermined force. Roll 210 is driven by a drive 220 and a gear mechanism 222. Due to the friction on the surface of roll 210, web 216 is conveyed in the direction of arrow P21. Web 216 has the tendency to be conveyed in the tangential direction away from the surface of the jacket of roll 210. By rotating the rotating frame 212 by an angle α about axis 214 corresponding to arrow P22, the transport direction of web 216 conveyed by roll 210 is also influenced. Accordingly, the position of the edge of web 216 in relation to a reference position can be modified in the direction of the shaft of roll 210.

In order to rotate rotating frame 212, an electrical drive 226 can for example be used that moves rotating frame 212 by small angular amounts, typically by 1°, clockwise or counterclockwise corresponding to arrow P22. Drive 226 contains a nut 228 in which a spindle 230 is moved back and forth. In order to ensure definite positions in the deflection of rotating frame 212, the unavoidable play due to tolerances between nut 228 and spindle 230 is prevented by a tension spring 232. This has the effect that when spindle 230 moves forward and backward, nut 228 always lies against the same flank of the spindle.

When there is a rotational movement in the direction of arrow P22, conveyed web 216 is subjected only to minimal forces. However, it is also possible to situate axis of rotation 214 off-center in relation to rotating frame 212. In the example according to FIG. 14, web 216 is guided centrically in relation to roll 210. However, it is also possible to situate web 216 off-center.

In addition, in the example according to FIG. 14, web 216 is narrower than roll 210. However, it is also possible for this web to extend past one or both sides of roll 210, so that the width of roll 210 is smaller than the width of web 216.

Figure 15:
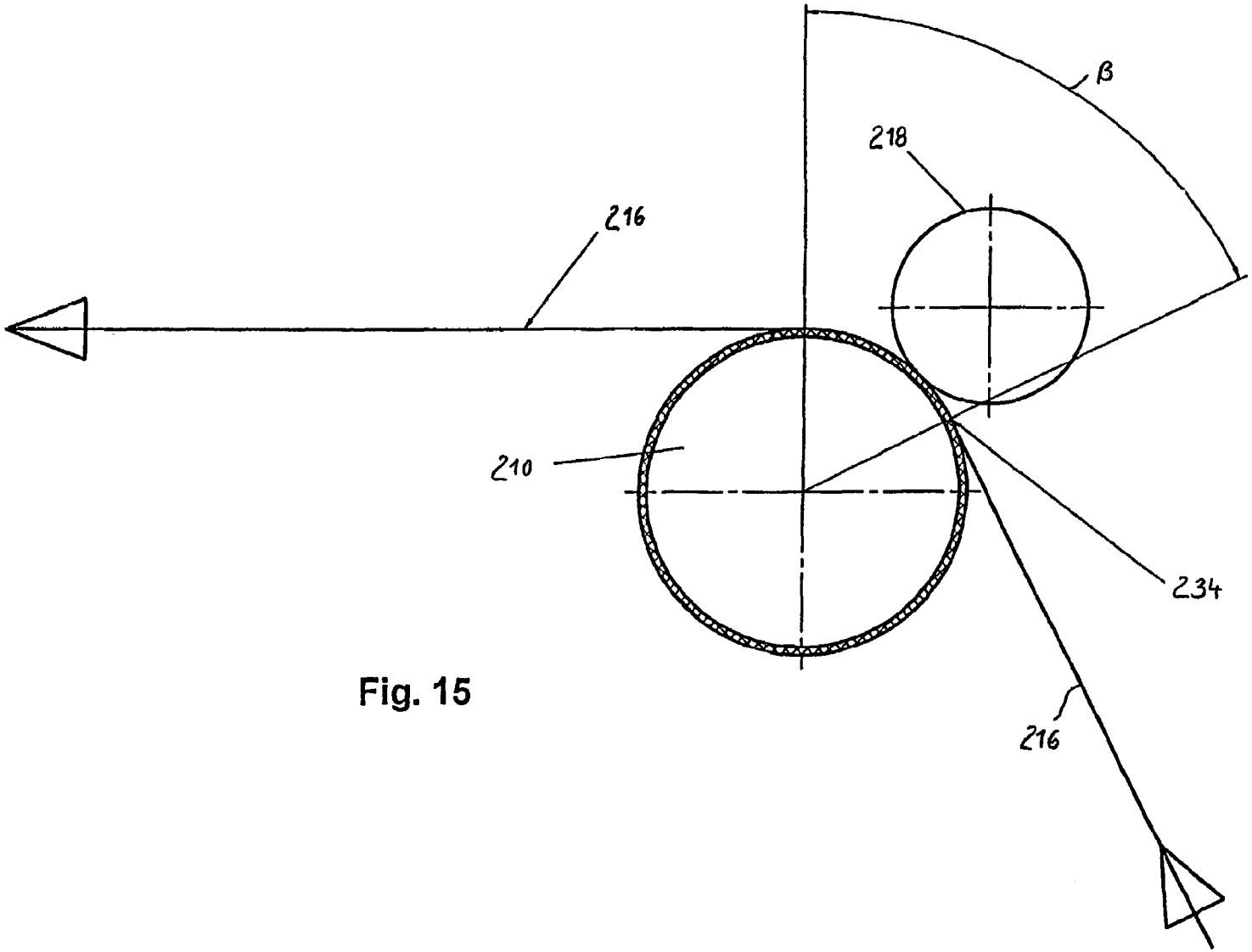
FIG. 15 shows a schematic view according to FIG. 1 in cross-section.

FIG. 15 schematically shows the arrangement according to FIG. 14 in cross-section. Web 216 comes into contact with the surface of roll 210 with a predetermined wrap angle β. Typically, the angular range for the wrap angle is between 3° and 80°. The greater the wrap angle, the stronger the frictional connection is with the surface of driven roll 210.

Wrap angle β defines the length of contact zone 234 in which web 216 makes contact with the surface of roll 210. This contact zone 234 has a smoothing effect on incoming web 216, so that the effect of the creasing of web 216 when roll 210 is rotated is reduced. The smoothing effect can be increased if the contact point of counter-roll 218 with web 216, seen in the direction of travel of web 216, is situated at the end of wrap angle β.

Roll 210 has on its surface a friction lining made for example of a pure closed cell material having a hardness of approximately 80 ShA. Spring-loaded counter-rolls 218 effect a largely drag-free transmission from driven roll 210 to web 216. Through a defined setting of the pressure forces of counter-rolls 218 on driven roll 210, a denting or damaging of the surface of roll 210 is avoided, and a constant surface speed of web 216 is thus ensured. Counter-rolls 218 have a lining made of a softer material than roll 210. For example, the lining is made of foamed pure material having a hardness of approximately 50 ShA.

Figure 16:
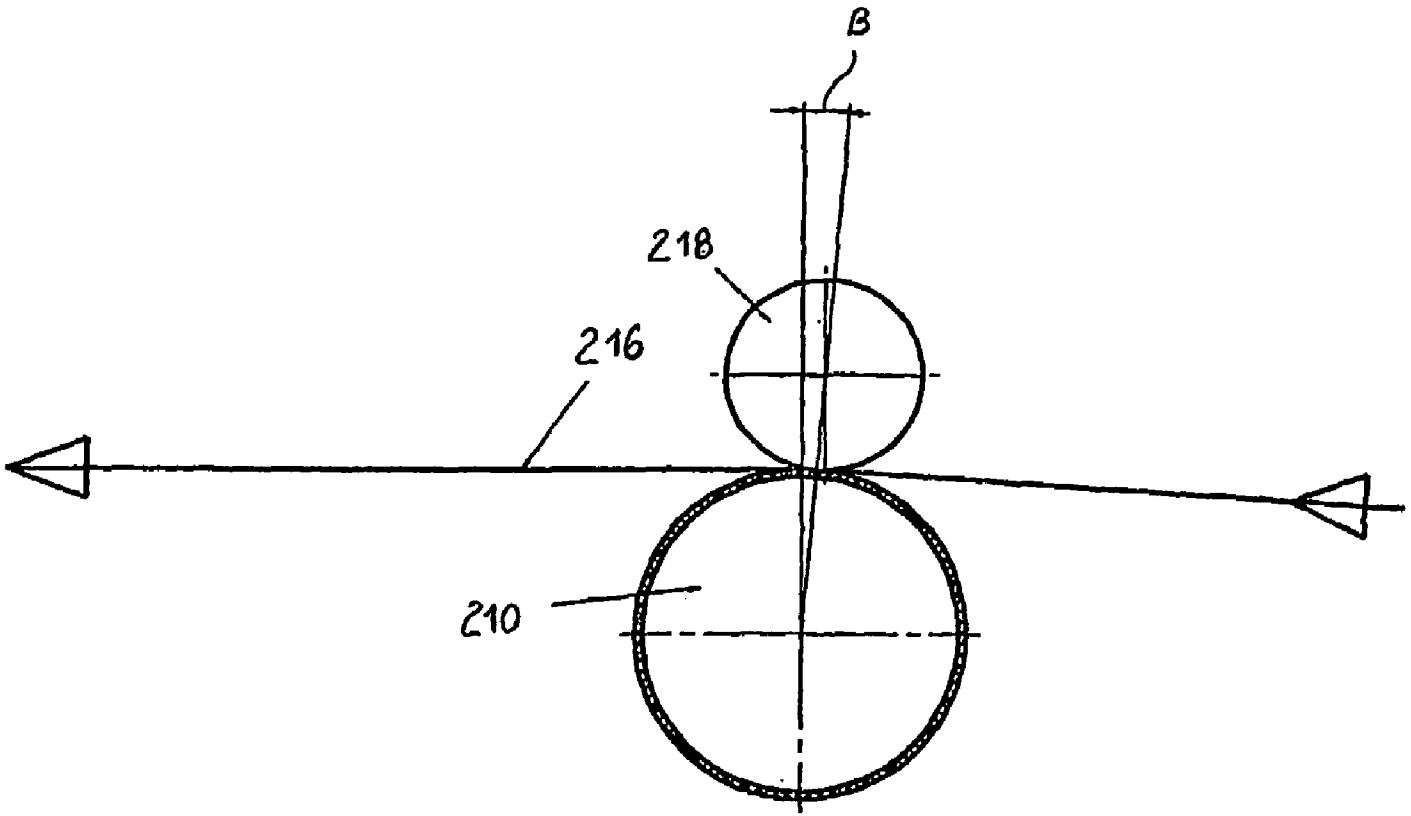
FIG. 16 shows an example with a small wrap angle.

FIG. 16 shows an example having a small wrap angle β. With a wrap angle of this sort as well, the position of web 216 can be shifted by rotating the rotating frame.

Figure 17:
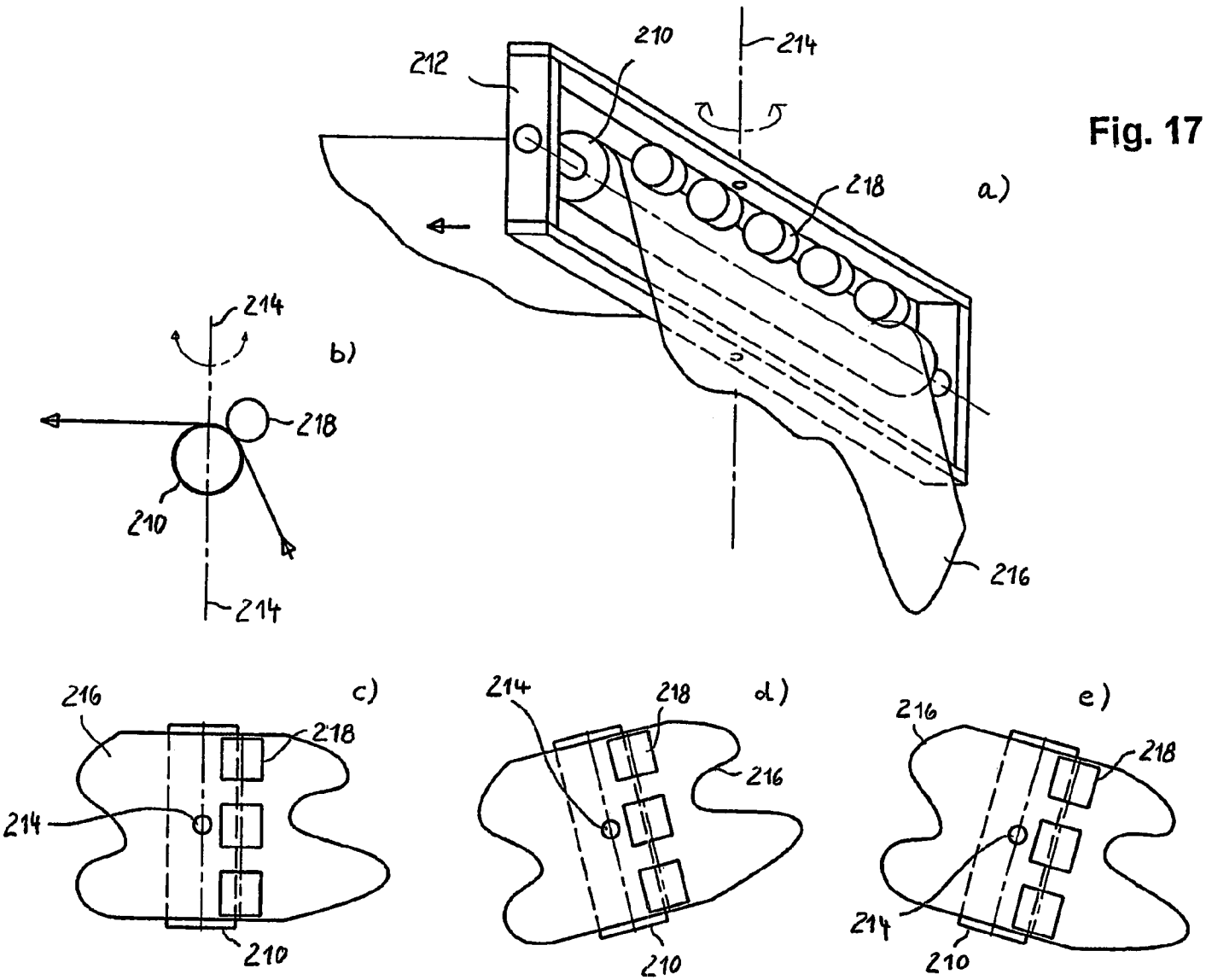
FIG. 17 shows examples in which the axis of rotation of the frame stands perpendicular to the drawn-off web.

FIG. 17 shows an example in which web 216 is fed in from below. In addition, axis of rotation 214 is situated perpendicular to drawn-off web 216, as can be seen in examples a) and b). Examples c), d), and e) show web guiding in a top view in example a), with various angles of rotation α in relation to a normal position of 0°.

Figure 18:
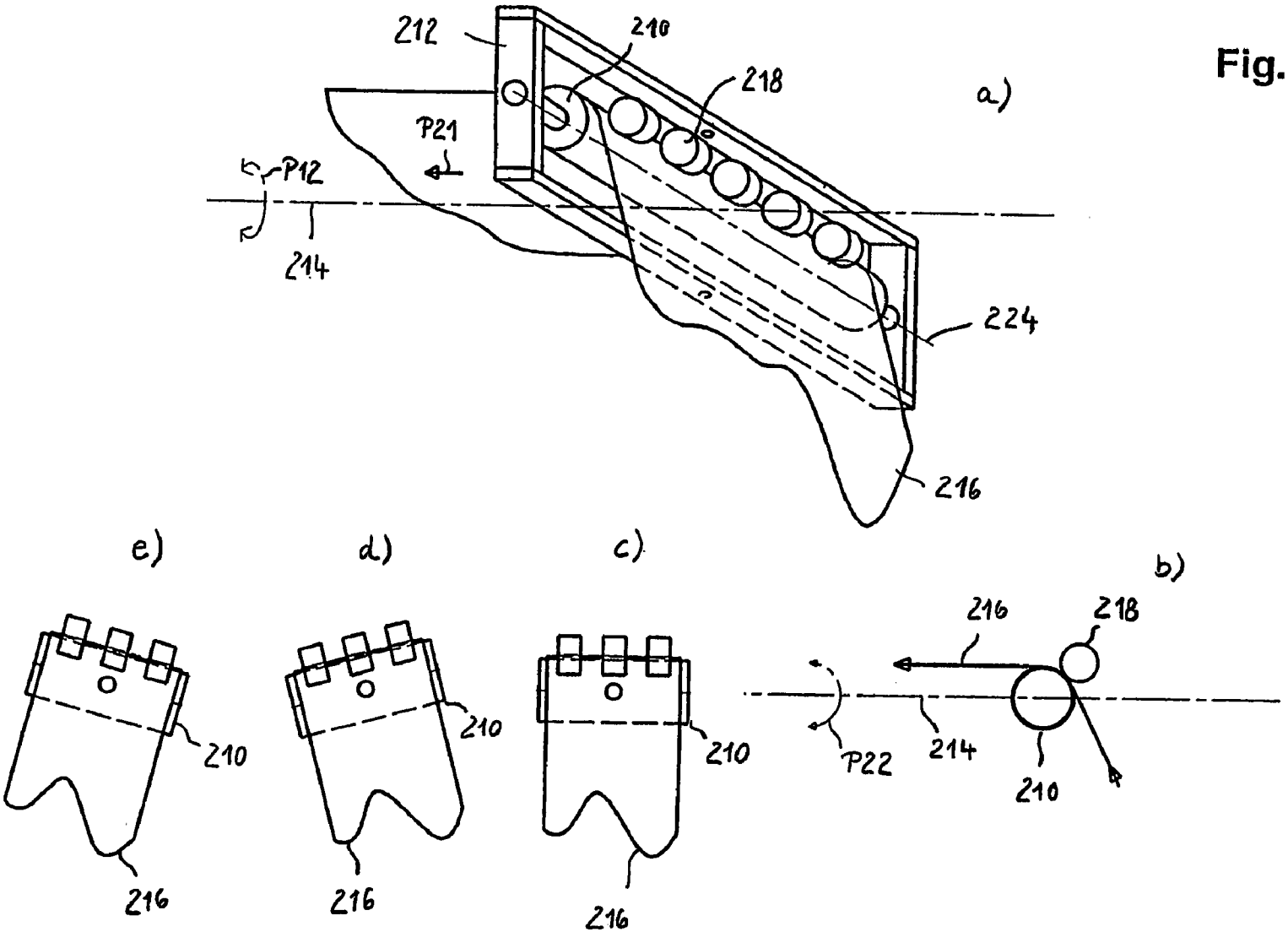
FIG. 18 shows examples in which the axis of rotation runs parallel to the direction of movement of the drawn-off web.

FIG. 18 shows an example in which axis of rotation 214 is situated parallel to the direction of transport of drawn-off web 216. When there is a rotation by angle of rotation P12, a change of the position of web 216 likewise takes place in the direction of shaft 224 of roll 210. Examples a) and b) illustrate the arrangement with axis of rotation 214 situated parallel to the direction of transport of web 216. Examples c), d), and e) show different deflections in the direction of angle of rotation P22, seen in the direction of axis of rotation 214.

Figure 19:
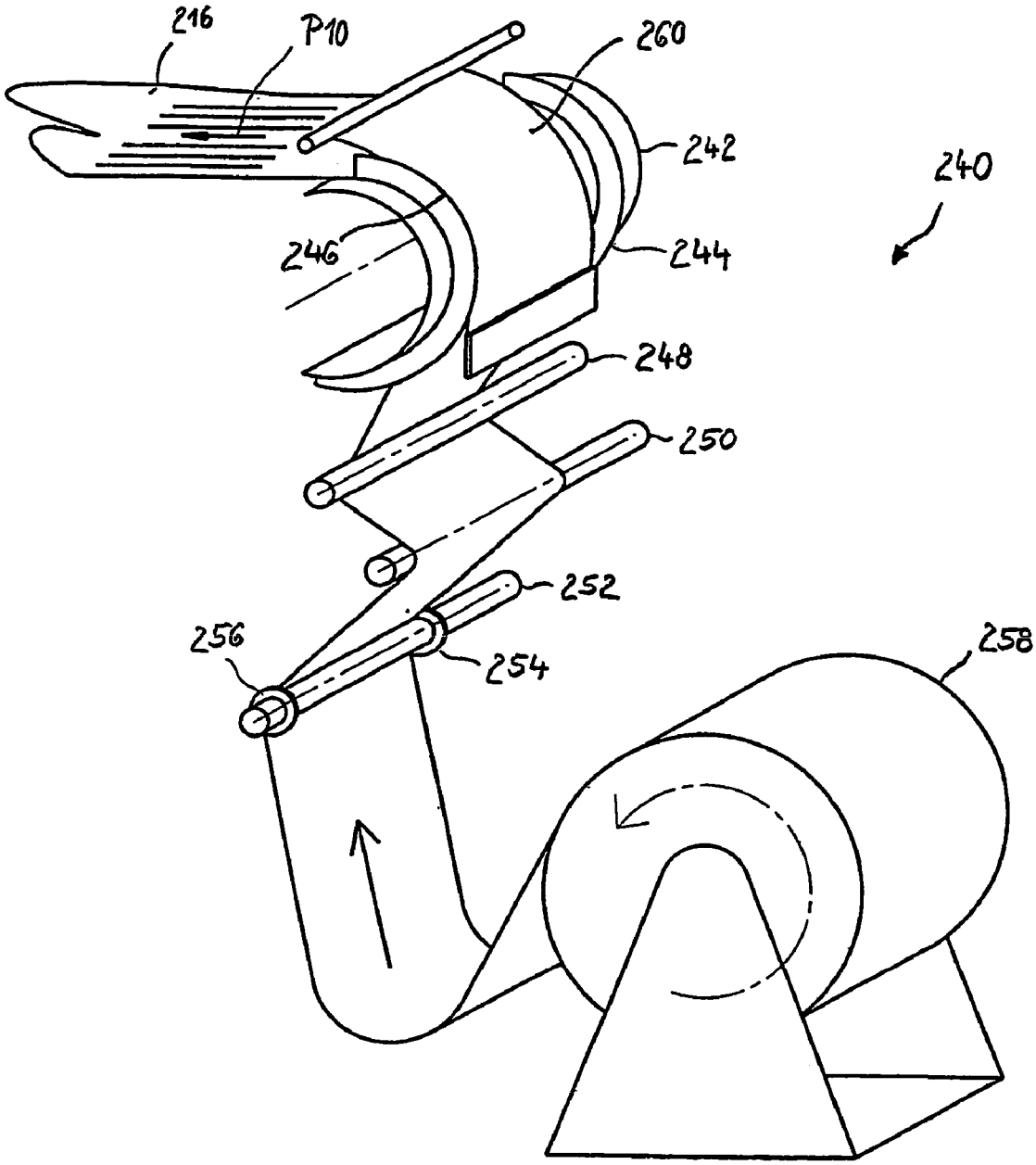
FIG. 19 shows an example of a web guiding device.

FIG. 19 shows a web guiding device 240 that is situated before the driven roll 210 depicted in the preceding Figures, seen in direction P10 of web transport. Web guiding device 240 acts on the one hand to preset a position of the edge of web 216, and on the other hand to create a predetermined web tension.

Web guiding device 240 contains a guide sheet 242, for example a guide plate, in the form of a partial cylinder jacket surface on which web 216 slides. Guide sheet 242 has, at each web edge side, plates 244, 246 that guide web 216 at both sides. The spacing from one another of plates 244, 246 can be adjusted to fit the width of web 216.

Before guide sheet 242, guide elements 248, 250, 252 are situated that can also bear plates, as is shown for guide element 252 with plates 254, 256. These plates 254, 256 have the effect that web 216, drawn off by a roll 258, already assumes a predetermined lateral position in the inlet area.

Guide elements 248, 250, 252 can be realized as cylinders over whose respective jacket surfaces web 216 is guided at predetermined wrap angles. The respective wrap angle can be set by modifying the position of the shafts of guide elements 248, 250, 252 relative to one another. This is important if the same web tension is required for web materials having different thicknesses.

In order to further set the web tension in a defined manner, a braking device is provided that engages guide sheet 242. For example, this braking device can be realized by a felt flap 260 that presses with a modifiable weight against web 216 sliding over guide sheet 242. In addition, devices as described in patent application DE 44 01 906 of the present applicant can be used for the pre-centering and tightening of web 216. The cited patent application DE 44 01 906 is hereby incorporated by reference into the content of the disclosure of the present application.

Figure 20:
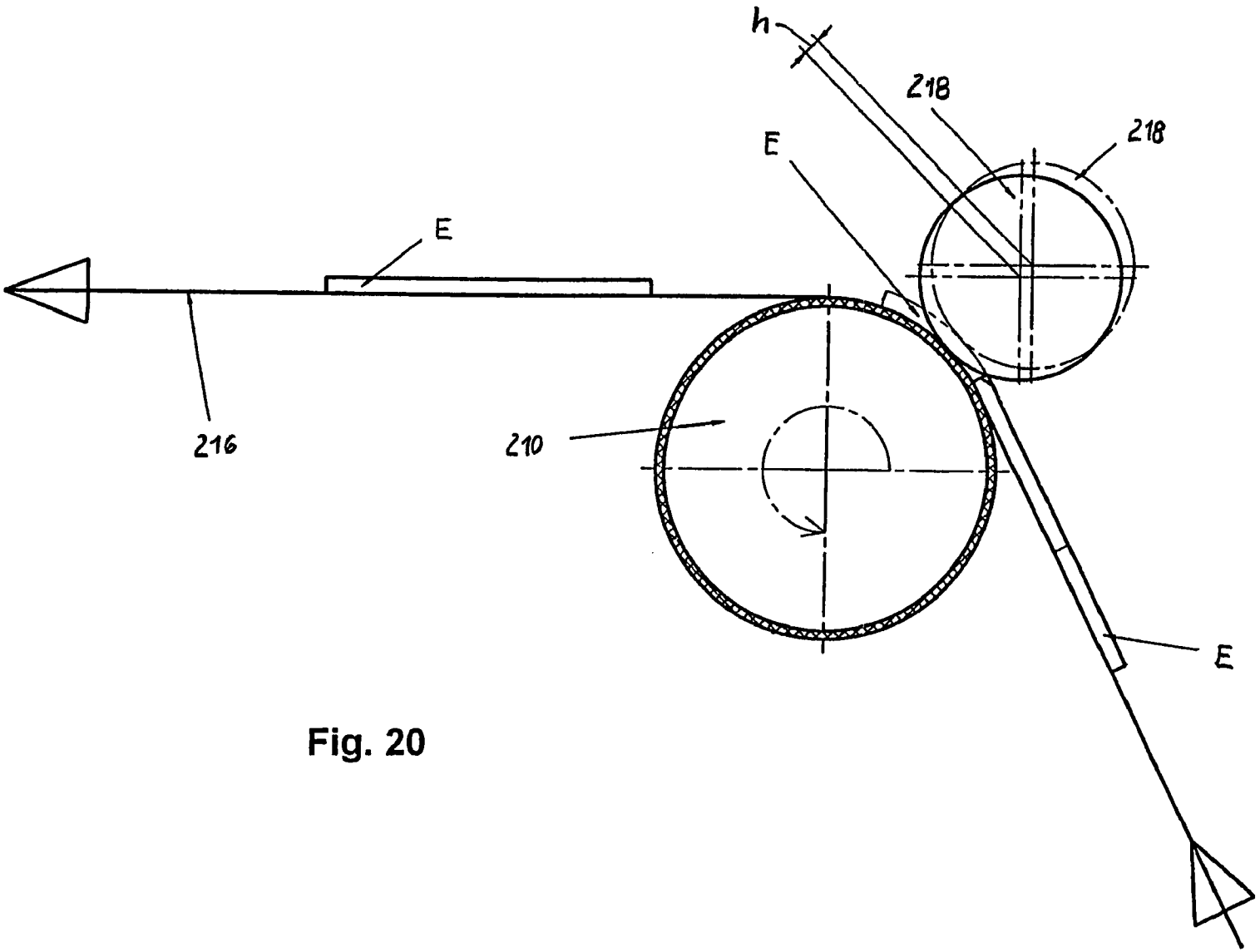
FIG. 20 shows an example of a web with attached adhesive labels.

FIG. 20 shows a web 216 provided with adhesive labels E. In a web 216 of this sort used in practice, in a printer or copier only the labels are to be printed. Here the problem arises that when the edge of a label meets counter-roll 218, this counter-roll is deflected by a travel distance h, as is shown in broken lines in FIG. 19. The travel work of counter-roll 218 that is applied causes an abrupt change in torque, with an accompanying change in the load angle on drive motor 220 (cf. FIG. 14). During operation, in a printer such an effect results in a worsening of the print image, in particular if fine gray rasters are printed. The use of a soft lining for counter-pressure roll 218, for example a foamed pure material, reduces this effect, because the travel energy of counter-roll 218 is absorbed by the elasticity of the lining.

Figure 21:
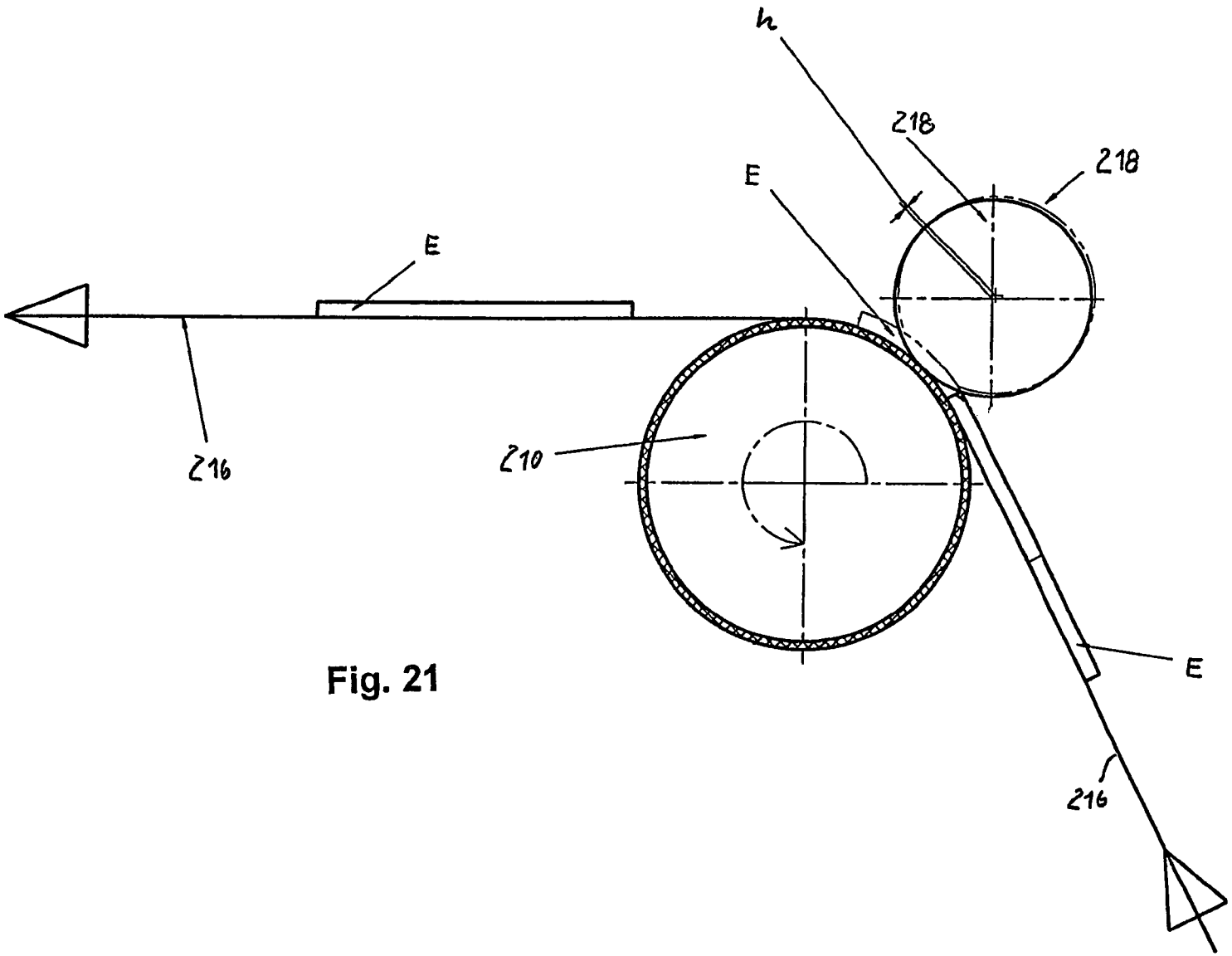
FIG. 21 shows the roll characteristic of the counter-roll having a soft lining or facing.

In FIG. 21, it is indicated that the travel h is reduced if a corresponding elastic lining is used.

Figure 22:
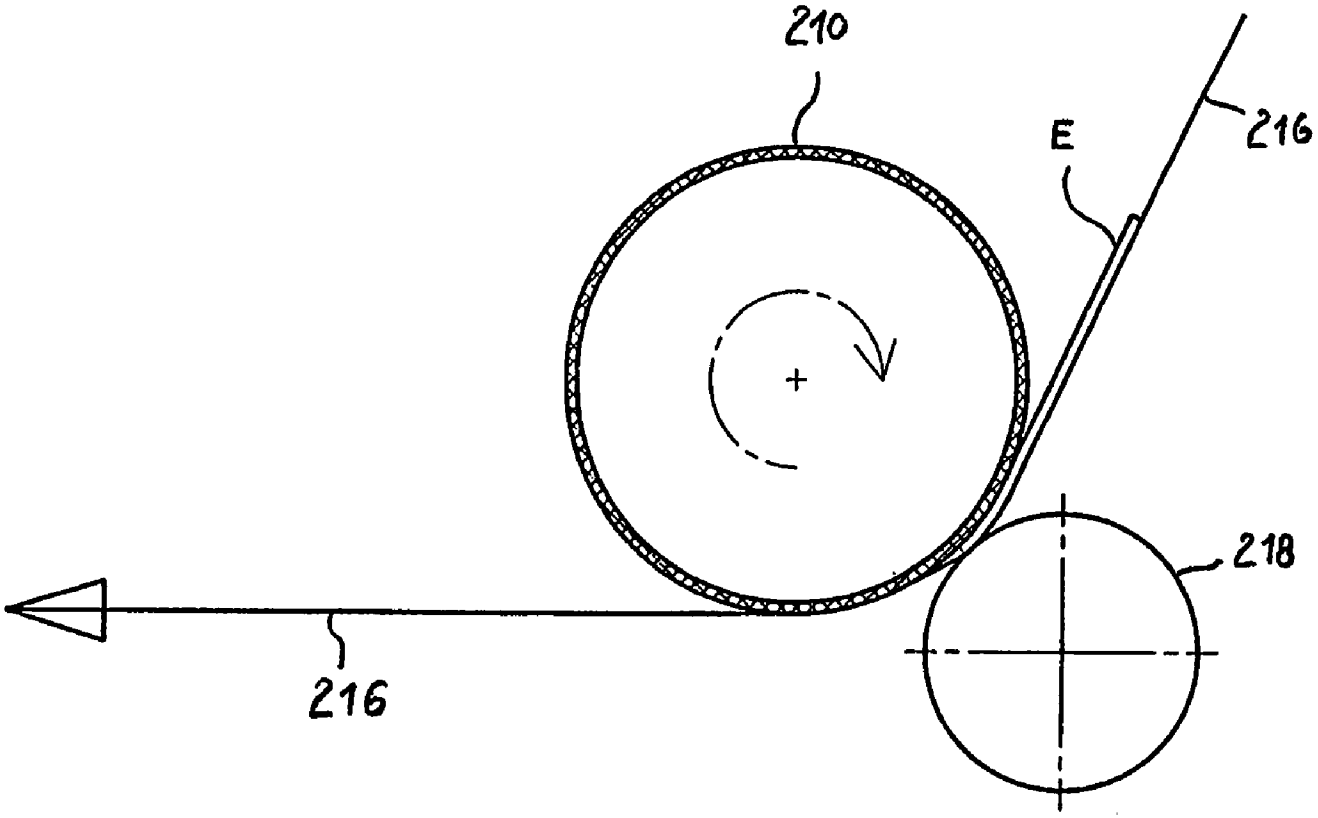
FIG. 22 shows a roll having labels that are glued to the side of the driven roll.

FIG. 22 shows an arrangement of web 216 in which the labels are situated on the side facing driven roll 210. Due to the wedge effect of web 216 on the edge of the labels, a kind of starting bevel is formed, so that the travel work for counter-roll 218 is not applied abruptly. Of course, the arrangement according to FIG. 22 can be combined with the arrangement according to FIG. 21.

Figure 23:
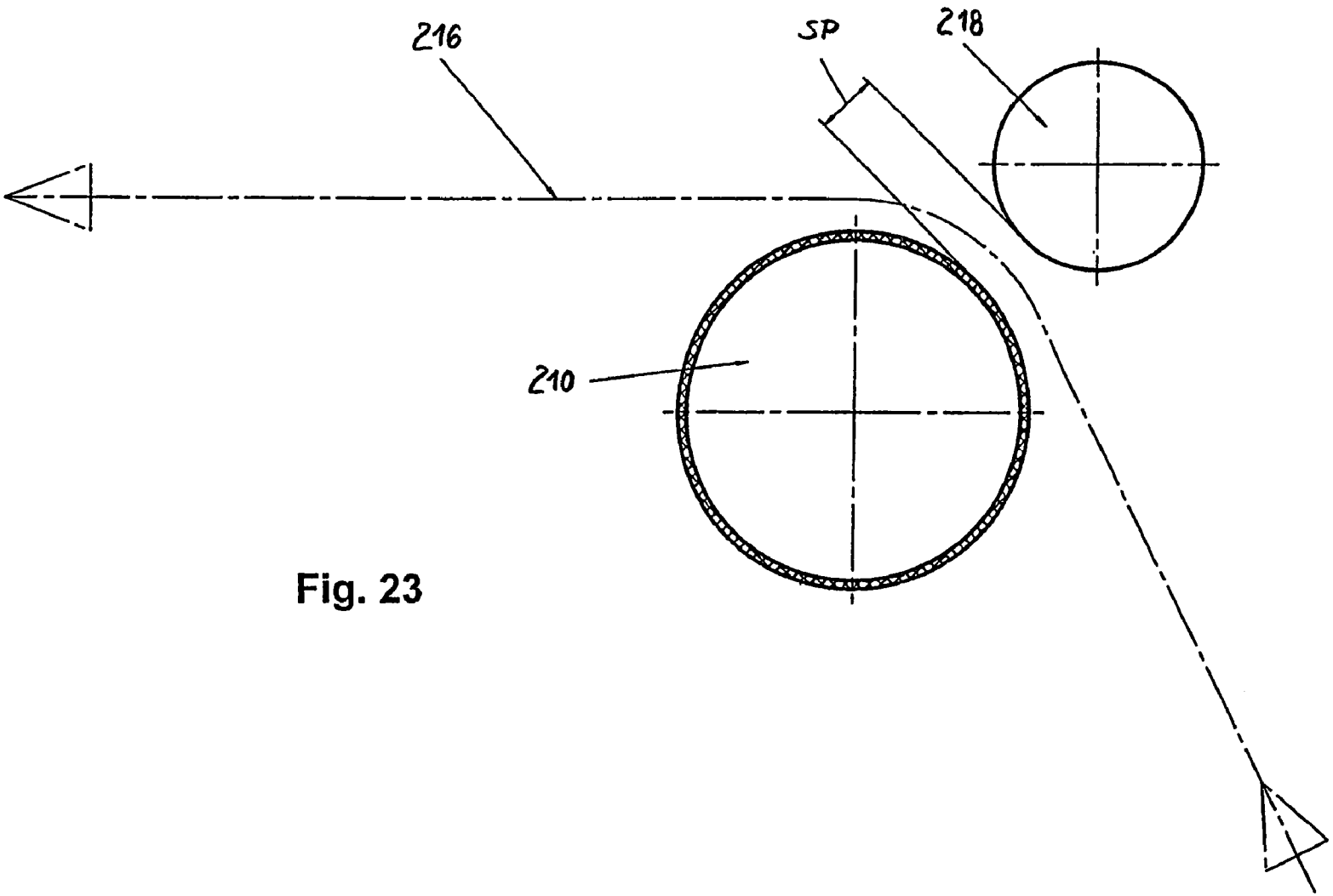
FIG. 23 shows an arrangement in which the counter-roll device is pivoted away.

FIG. 23 illustrates that counter-rolls 218 can be jointly pivoted away from driven roll 210, thus opening a gap SP that is sufficiently large to admit a web 216, shown in broken lines. In this way, the putting into place of a new web 216 is made easier.

Figure 24:
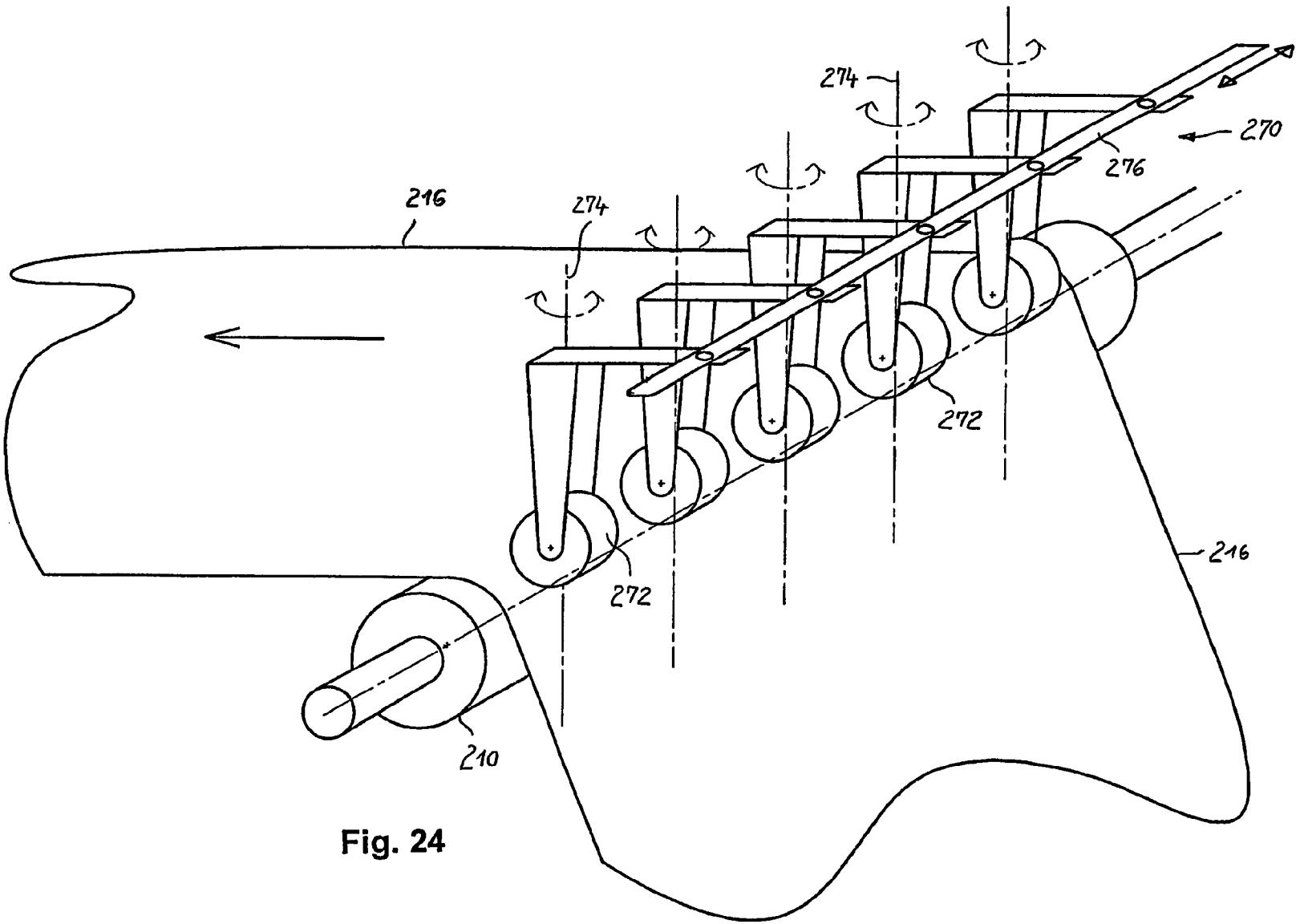
FIG. 24 shows a web guiding device having a stationary driven roll and a multiplicity of counter-rolls that can be rotated.

FIG. 24 shows a further example of the preferred embodiment. Driven roll 210 is situated in stationary fashion, i.e., its axis does not change. Counter-roll device 270 contains a multiplicity of rolls 272 that press web 216 against roll 210. The multiplicity of rolls 272 and roll 210 are held by a rotating frame. Each roll 272 can be pivoted to the same degree about an axis of rotation 274. Through a rod 276 that engages with a lever end for each roll 272, the angle of rotation of the respective roll 272 can be adjusted. Here as well, web 216 has the tendency to be conveyed away in a direction tangential to the surface of the respective roll 272, and in this way the position of the edge of web 216 can be modified in the direction of the roll shaft. The additional variations described above, for example with respect to the linings of driven roll 210 and the linings of rolls 272, can also be used here.

Many variations are possible. The rotating frame described in FIG. 14 can for example be part of a control circuit. The actual position of the edge of web 216 is determined with the aid of a sensor in relation to a target position. Dependent on the signal from the sensor, the angle of rotation P12 of the frame is adjusted in steps or continuously in such a way that a control deviation between the actual position and the target position of the edge is reduced.

In relation to the exemplary embodiment according to FIG. 24, all counter-pressure rolls 272 are controlled simultaneously with the aid of rod 276 and a drive. This drive can be part of a control circuit. With the aid of a sensor, the actual position of the edge in relation to a target position is determined. Depending on the signal of the sensor, the angle of rotation for each counter-roll 272 is adjusted in such a way that a control deviation between the actual position and the target position of the edge is reduced or eliminated.

The depicted examples of the various aspects of the preferred embodiment can be advantageously combined with one another, resulting in further variations. Thus, the rotating frame shown in FIGS. 14 and 24 can be used in the example according to FIGS. 1 and 7. The controlling of the side edge of the web according to FIGS. 7 to 13 can be used in the examples according to FIGS. 1 to 7 and FIGS. 14 to 24.

Although in the drawings, and in the above description, a preferred exemplary embodiment has been shown and described in detail, these should be understood only as examples, and not as limiting the present invention. It is hereby noted that only the preferred exemplary embodiment has embodiments have been represented and described, and that all changes and modifications lying within the scope of protection of the present invention currently and in the future are to be protected.

We claim as our invention:

1. A device for guiding an endless web, comprising:

a first positionable roll which guides the endless web directly to an additional positionable roll with a predetermined wrap angle on each positionable roll, shafts of said positionable rolls lying parallel to one another in a plane and being held by a frame;

the web being fed to and led away from the positionable rolls via a respective first stationary roll and a respective additional stationary roll;

the frame being pivotable relative to the stationary rolls about a first axis of rotation which is substantially perpendicular to said plane in order to modify a position of an edge of the web;

the frame being pivotable relative to the stationary rolls about a second axis of rotation parallel to a movement direction of the web between the first and additional positionable rolls with an actuated adjustment device that is actuated by at least one of the functions selected from the group consisting of manually, electrically, hydraulically, and pneumatically to make said web rigid to prevent sagging; and along the web there is situated at least one sensor that acquires a sagging comprising a movement in a direction perpendicular to a plane of the web at one side of the web and indicates it via a control device, and in which, dependent on the indication, the frame is pivoted about the second axis of rotation.

2. A device according to claim 1 in which an inlet roll is situated before the frame and a stabilizing roll is positioned after the frame as said stationary rolls, and said stationary rolls feed the web in and lead it away.

3. A device according to claim 1 in which a screw-nut combination is used for the pivot.

4. A device according to claim 1 in which a sensor is situated in a vicinity of the frame at both sides of the web.

5. A device according to claim 1 in which a force sensor is used that acquires web tension.

6. A device according to claim 5 in which the force sensor acquires a force that is exerted at one side at an inlet roll via which the web is fed into the frame.

7. A device according to claim 1 in which a distribution of a tension of the web in an area between the two positionable rolls of the frame is acquired by sensors as a one-sided sagging or as a wave.

8. A device according to claim 1 in which, as seen in the movement direction of the web a fixing station that fixes a toner image is situated after a transfer station.

9. A device according to claim 8 in which as seen in the movement direction of the web after the fixing station there is situated a draw-off device for the web that is pivotable in order to correct a one-sided sagging of the web.

10. A device according to claim 8 in which web tension in an area of the fixing station for fixing a toner image on the web is acquired by at least one sensor, and a pivoting of a draw-off device takes place dependent on a signal of the sensor.

11. A device according to claim 10 in which the draw-off device contains two rolls that are pivotable about an axis of rotation.

12. A device according to claim 11 in which the axis of rotation runs substantially perpendicular to the web.

13. A device according to claim 1 in which first sensors on the pivotable frame as well as second sensors in an area of a fixing station monitor the web, a control unit which pivots the pivotable frame about the second axis of rotation dependent on signals from the first sensors and the control unit pivots a draw-off device about an axis of rotation dependent on signals from the second sensors.

14. A device according claim 1 in which first sensors in an area of an inlet roll and second sensors in an area of a fixing station monitor the web, and in which a control unit pivots the pivotable frame about the second axis of rotation dependent on signals from the first sensors, and pivots a draw-off device about an axis of rotation dependent on signals from the second sensors.

15. A device according to claim 1 in which only first sensors in an area of an inlet roll acquire the web, and a control unit rotates the pivotable frame about the second axis and rotates a draw-off device about an axis of rotation dependent on signals from first sensors.

16. A device according to claim 1 in which the endless web is designed as a paper web without edge perforation.

17. A device according to claim 1 wherein it is used in a printer or copier.

18. A method for guiding an endless web, comprising the steps of:

guiding the endless web via a first positionable roll directly to an additional positionable roll with a predetermined angle of wrap on each roll, shafts of the rolls lying parallel to one another in a plane and being held by a frame;

the web being fed to an led away from the positionable rolls held by the frame via a respective first stationary roll and a respective additional stationary roll;

the frame being pivotable relative to the stationary rolls about a first axis of rotation substantially perpendicular to the plane in order to modify a position of an edge of the web;

the frame being pivotable relative to the stationary rolls about a second axis of rotation parallel to a movement direction of the web between the positionable rolls with an actuated adjustment device that is actuated by at least one of the functions selected from the group consisting of manually, electrically, hydraulically, and pneumatically to make said web rigid to prevent sagging; and positioning at least one sensor situated along the web that detects a sagging comprising a movement in a direction perpendicular to a plane of said web of one side of the web, the at least one sensor producing a signal dependent on the detected sagging, said signal being supplied to a control circuit that pivots the frame about the second axis of rotation in such a way that the one-sided sagging of the web is reduced or is controlled to a value zero.

19. A method according to claim 18 in which, as seen in a movement direction of the web, there is situated after a fixing station a draw-off device for the web that pivots in order to correct a one-sided sagging of the web.

* * * * *